US010563331B2

(12) United States Patent
Gupta

(10) Patent No.: US 10,563,331 B2
(45) Date of Patent: Feb. 18, 2020

(54) FABRIC CLAMP ADAPTED TO PASS UNDER PRESSER FOOT OF SEWING MACHINE

(71) Applicant: Nikhil Gupta, Schaumburg, IL (US)

(72) Inventor: Nikhil Gupta, Schaumburg, IL (US)

(73) Assignee: GHI INC., Schaumburg, IL (US)

( * ) Notice: Subject to any disclaimer, the term of this patent is extended or adjusted under 35 U.S.C. 154(b) by 235 days.

(21) Appl. No.: 15/439,549

(22) Filed: Feb. 22, 2017

(65) Prior Publication Data

US 2018/0112340 A1 Apr. 26, 2018

Related U.S. Application Data

(60) Provisional application No. 62/412,800, filed on Oct. 25, 2016.

(51) Int. Cl.

| | |
|---|---|
| ***D05B 29/12*** | (2006.01) |
| ***D05B 35/12*** | (2006.01) |
| ***D05B 35/02*** | (2006.01) |
| ***D05B 29/00*** | (2006.01) |

(52) U.S. Cl.

CPC ..... *D05B 35/12* (2013.01); *D05B 29/00* (2013.01); *D05B 35/02* (2013.01); *D05D 2305/00* (2013.01)

(58) Field of Classification Search

CPC ..... D05B 35/12; D05B 29/00; D05B 35/02; D05B 39/00; D05D 2305/00

See application file for complete search history.

(56) References Cited

U.S. PATENT DOCUMENTS

| | | | | |
|---|---|---|---|---|
| 2,629,154 A * | 2/1953 | Micucci | B42F 1/006 211/118 |
| 2,817,889 A * | 12/1957 | Kalal | A47H 13/04 24/365 |
| 2,990,551 A * | 7/1961 | Schreter | A44B 6/00 2/145 |
| 3,762,108 A * | 10/1973 | Pierson | B29C 65/565 24/555 |
| 6,477,751 B2 * | 11/2002 | Baumdicker | A44B 99/00 24/306 |
| 8,336,173 B2 * | 12/2012 | Pontaoe | A44B 99/00 24/265 EC |

(Continued)

*Primary Examiner* — Robert Sandy
*Assistant Examiner* — Louis A Mercado
(74) *Attorney, Agent, or Firm* — Robert S. Alexander; Ferrells, PLLC; Anna L. Kinney

(57) ABSTRACT

A fabric clamp that passes under the presser foot of a sewing machine is provided. The clamp has a loop of resilient strip folded over upon itself, an upper slotted lever, and a lower slotted lever. The resilient strip has an upper portion, the terminus of which defines an upper planar jaw, and a generally planar lower portion, the terminus of which defines a lower planar tongue, joined by a curvilinear central portion. The upper portion of the resilient strip passes through the upper lever. The lower portion of the resilient strip passes through the lower lever. The total transverse width of the portions of the tongue is no more than about 12 mm. The curvilinear portion urges the jaw and tongue together. When the upper jaw and the tongue are adjacent and the levers are urged together, the jaw and the tongue are displaced from adjacent deployment.

20 Claims, 23 Drawing Sheets

(56) References Cited

U.S. PATENT DOCUMENTS

| | | | | |
|---|---|---|---|---|
| 8,381,359 | B1 * | 2/2013 | McArdle | A45F 5/02 2/209.13 |
| D697,779 | S * | 1/2014 | Iwasaki | D8/72 |
| D752,342 | S * | 3/2016 | Woods | D3/219 |
| 9,511,615 | B2 * | 12/2016 | Isserstedt | B42F 1/006 |
| D781,571 | S * | 3/2017 | Moerer | D3/215 |
| D817,804 | S * | 5/2018 | Antinone | D11/78.1 |
| 2006/0213036 | A1 * | 9/2006 | Flowers | A41F 17/02 24/72.1 |
| 2008/0289159 | A1 * | 11/2008 | Solich | D06F 55/00 24/571 |
| 2015/0342313 | A1 * | 12/2015 | Antinone | B42F 1/08 342/357.51 |

* cited by examiner 64
16
10
35.64°
28.02
12.05
1.5
10.15
11.15
2
3.4
6
.6
8.89
R 2.11
R 2.11
R 2.11
R 25.71
R 4.73
10.52
26.24
28.02
0.5

FABRIC CLAMP ADAPTED TO PASS UNDER PRESSER FOOT OF SEWING MACHINE

CLAIM FOR PRIORITY

This Non-Provisional patent application is based on U.S. Provisional Patent Application Ser. No. 62/412,800, filed on Oct. 25, 2016, the priority of which is claimed, and the disclosure of which is incorporated by reference.

BACKGROUND OF THE INVENTION

Sewing is a widely practiced art, both for utilitarian purposes and as a recreational endeavor. In general, sewing consists of joining multiple pieces of fabric together using a needle and thread. For large items, sewing is almost always performed using a sewing machine or a serger. To ensure accuracy in sewing, it is common to temporarily fasten the pieces of fabric to be joined to each other using pins. However this can be time-consuming and imprecise as the pins cannot ensure against all movement of the pieces of fabric with respect to each other. This invention relates to a removable repositionable clamp in which multiple pieces of fabric can be held together firmly. Significantly, the clamp is configured such that the jaw portions of the clamp are not only able to pass under the presser foot of a sewing machine or serger so that the fabrics are retained firmly in place until the portions to be joined have passed under the presser foot and the seam has been formed but also that proper feed of the fabric is maintained when the clip passes over the feed dogs and under the presser foot.

Previously, superficially similar clips, generally as depicted in Iwasaki, US D697,779 S, Issued Jan. 21, 2014 and sold under the denomination "Wonder Clips"® by Clover® Mfg. have been suggested for use in connection with sewing. However these clips suffer from two deficiencies in that the seamstress cannot sew over them, and even though they can sew "close" to them, the thickness of the clamp can distort the seam as the fabric is lifted off of the throat plate of the sewing machine by the very thickness of the lower jaw of the clamp. The present invention overcomes these deficiencies. A seamstress cannot sew over the Wonder Clips® as the Wonder Clip® has a base with substantial thickness which raises the fabric above the plane of the base plate of a sewing machine as it approaches the presser foot, preventing the fabric from lying essentially flat, so the clip should not remain in place as it approaches the rear of the presser foot. If the seamstress attempts to bring the clip too close to the presser foot, due to the thickness of the clip where it engages the fabric, it will likely either be displaced upwardly or otherwise interfere with the line of stitching that the seamstress is attempting. Even if the clamp were made drastically thinner, it would still prevent the feed dogs on the sewing machine from properly gripping the fabric where it is retained in the clip as the width of the lower jaw is such that the feed dogs may not be able to grab the fabric on both sides of the needle slot to ensure proper feed under the presser foot.

On commonly encountered sewing machines and sergers, feed dogs having top surfaces covered with small penetrating points, usually pyramidal, are adapted to grip the fabric from below, pulling it under the presser foot and past the reciprocating needle without damaging the fabric. In one very common style of sewing machine called the drop feed design, the feed dogs reside in elongated slots in the base of the sewing machine and undergo a compound motion in operation, rising up through the base plate (also referred to as the stitching plate, needle plate or throat plate) of the machine and engaging the lower surface of the fabric at the beginning of one cycle. Thereafter, the feed dogs move forward in the slot pulling the fabric with them through the sewing or stitching zone until they approach the forward terminus of the slot, at which point the feed dogs begin to retract into the machine so that they no longer engage the fabric whilst another set of feed dogs raises in the slot to grasp the fabric prior to the first set releasing. Thereafter, the feed dogs move downwardly and rearwardly in the machine and then rise up near the beginning of the slot to reengage the fabric and repeat the cycle. Typically, multiple feed dogs are provided so that that there is always at least one feed dog, more preferably one pair of feed dogs, engaging the fabric and pressing it against the presser foot while pulling it forwardly through the stitching area of the sewing machine. Often machines will have three or four sets of feed dogs spaced around the needle slot with each set comprising four feed dogs in the most common designs. While many basic machines have a pair of narrowly spaced feed dogs of considerable length, say 30 mm or so, to ease formation of evenly spaced straight stitches, other machines, optimized to allow more freedom in stitch direction, may have more widely spaced but shorter feed dogs to allow for wider stitches while allowing the seamstress to more easily form stitches following a path other than straight as desired by the seamstress.

Because the jaws of the Wonder Clip® are relatively thick and wide, if the clip is close to the seam being formed, the seamstress can neither pass the clips directly under the presser foot nor allow them to pass too close to the stitching area, and accordingly, must halt the stitching process to remove the clip as it approaches the presser foot. Further, unless the clip is laterally displaced from the line of the presser foot by a considerable distance, it must often be removed or the fabric will not feed perfectly as the thickness of the Wonder Clip® is so pronounced. Even if the jaws of the Wonder Clip® were somehow made sufficiently thin to pass under the presser foot, they would interfere with ideal feeding of the fabric through the stitching zone as the Wonder Clip®'s width, which in use will normally be parallel to the direction of travel of the fabric, would interfere with the proper grip by the feed dogs on the fabric as it passes through the stitching zone under the presser foot as the feed dogs would impact upon the clip rather than gripping the fabric and urging the fabric through the stitching zone.

SUMMARY OF THE INVENTION

The present clip overcomes these issues by providing a clip where the jaws are formed from a thin tempered stainless steel plate curved or bent into a U-shape or ω-shape where the natural resiliency of the stainless steel tends to hold the jaws shut against each other (FIG. 1). In many cases, the upper jaw will have two widely spaced arms extending normal to the base of the curvilinear portion with either a tongue or lower jaw nesting between the two arms of the upper jaw. Often the two arms will be joined by a header parallel to the fold axis of the U or ω, with the length of the arms being such that the tongue or lower jaw will nest in the opening defined by the arms and header, thereby reducing the effective height of the clamp. Optionally, the upper jaw may have any convenient width as there is no necessity to provide a central aperture therein even though provision of a central aperture does help lower the overall thickness of the working end of the clamp facilitating passage under the presser foot. In use, the smaller jaw goes under the fabric and may directly contact one or more of the feed dogs as the fabric passes under the presser foot (FIGS. 15-18). In other cases, the lower jaw of the clip will not contact any of the feed dogs at all but will pass slightly outboard of them. In one form of clip, an aperture is provided in the lower, smaller jaw (FIGS. 4 and 5) so if that portion of the clip does contact the feed dogs, there will still be a significant amount of fabric in contact with the dogs as the clip passes between the presser foot and fabric; so accordingly the feeds dogs will still be gripping enough fabric as the clip passes near or under the presser foot to move the fabric though the stitching zone. It is particularly advantageous that the width of the portions of the "frame" around the aperture, parallel to the direction of motion through the stitching area, be restricted so that the feed dogs will easily grip fabric on both sides of the frame as it passes through the stitching zone. Generally, the width of the arms of the lower jaw will be less than about 6 mm, preferably less than about 5 mm, more preferably less than about 4 mm, still more preferably less than about 3.5 mm and most preferably between about 1.5 and 3 mm in width. In this way, it can be ensured that even relatively short feed dogs will still be able to maintain a continuous grasp on the fabric as the lower arm passes between the presser foot and base plate. If an aperture is provided in the lower jaw, it should have a width of at least about 1 mm, preferably at least about 1.5 mm, more preferably at least about 2 mm, still more preferably at least about 3 mm, more preferably still of at least about 4 mm, even still more preferably at least about 5 mm, even yet more preferably at least about 6 mm and most preferably at least about 2 to 6 mm.

Jaws for the present invention may be comprised of any sufficiently rigid material to enable the jaws to urge layers of fabric together while having a thickness of less than about 4 mm, preferably less than about 3 mm, more preferably less than about 2 mm and most preferably between about 0.25 and 2 mm. Both metals and high-strength engineering resins may be used. Stainless steel is the most preferred material as its high strength and acceptable formability makes it possible to form quite thin jaws having sufficient strength to firmly retain layers of material in place during the sewing process. Preferably, the jaws are comprised of tempered stainless steel, often referred to as spring steel, having a thickness of between about 0.25 and 2 mm, more preferably between about 0.35 and 2.0 mm, still more preferably between about 0.40 mm and 1.5 mm; still more preferably between about 0.4 and 1.5 mm and most preferably between about 0.4 and 1 mm. Ideally, the thickness of each stainless steel jaw will be between 0.45 mm and 0.65 mm. Commonly, a thickness of between about 0.25 mm and 1.5 mm will prove to be highly practical.

The fabric clamp of the present invention is adapted to pass under the presser foot of a sewing machine and comprises: a loop of resilient strip folded over upon itself, defining: an upper portion; and a generally planar lower portion; said upper portion and said generally planar lower portion being joined by a curvilinear central portion forming a U or ω shape; the terminus of said upper portion being generally planar and defining an upper planar jaw joined to said curvilinear central portion through an obtuse oblique, said upper planar jaw preferably comprising a frame circumscribing a central aperture; the terminus of said generally planar lower portion of said loop of resilient strip defining a lower planar tongue, said curvilinear section urging said jaw and said tongue into interjacent generally coplanar deployment, preferably with said tongue disposed in said central aperture and protruding through said aperture when not engaging fabric; each of the upper and lower portions of the loop passing through a respective rearwardly extending lever, an upper lever for the upper jaw, and a lower lever for the lower jaw, the levers being configured to ease separation of the jaws when desired by the seamstress, the portions of said upper lever and said lower lever extending rearwardly beyond said curvilinear portion being spaced apart when said upper and lower jaws are in interjacent generally coplanar deployment and urgable together against the resilience of said curvilinear upper portion to displace said jaw and said tongue from interjacent generally coplanar deployment; wherein the transverse width of said tongue is no more than about 6 mm, preferably less than about 5 mm, more preferably less than about 4 mm, advantageously less than about 3.5 mm and most preferably between about 3.5 and 5.5 mm.

In another embodiment, the fabric clamp of the present invention adapted to pass under the presser foot of a sewing machine, comprises: a loop of resilient strip folded over upon itself, defining: an upper portion; and a generally planar lower portion; said upper portion and said generally planar lower portion being joined by a curvilinear central U or ω portion; the terminus of said upper portion being generally planar and defining an upper planar jaw joined to said curvilinear central portion through an obtuse oblique, said upper planar jaw preferably comprising a frame circumscribing a central aperture; the terminus of said generally planar lower portion of said loop of resilient strip defining a lower planar tongue, said curvilinear section urging said jaw and said tongue into, preferably interjacent, generally coplanar deployment with said tongue preferably disposed in said central aperture; wherein said upper portion of said resilient strip passes through a slotted upper lever which engages the lower surface of said upper portion of the loop at a location generally in the region of the obtuse oblique between said upper jaw and said curvilinear portion and preferably engages the upper surface of said resilient strip at a location proximate, but spaced from said U or ω, between said U or ω and the location at which said upper lever engages the lower surface of said upper portion, said upper lever extending rearwardly past said curvilinear portion; and wherein said lower portion of said resilient strip passes through a slotted lower lever, a lower surface of said lower lever engaging the upper surface of said lower portion of said resilient strip between said curvilinear U or ω portion and said terminus of said generally planar lower section whilst preferably a lower surface of said lower lever engages the upper surface of said resilient strip between the curvilinear U or ω portion and the location at which the lower surface of the lower lever engages the upper surface of the lower portion, said slotted lower lever extending rearwardly past said curvilinear U or ω portion, said upper lever and said lower lever bearing against each other along a transversely extending area between said curvilinear U or ω portion of said resilient strip and said jaws; the portions of said upper lever and said lower lever extending rearwardly beyond said curvilinear U or ω portion being spaced apart when said upper and lower jaws are in generally coplanar deployment rearward portions of said levers are urgable together against the resilience of said curvilinear U or ω portion to displace said jaw and said tongue from generally coplanar deployment; wherein the transverse width of the tongue or of each arm of said frame on said lower jaw is no more than about 6 mm, preferably less than about 5 mm, more preferably less than about 4 mm and most preferably less than about 3.5 mm. Preferably the tongue of the lower jaw is provided with a central aperture with the lateral edges of the frame surrounding said central aperture having a width of no more than about 5 mm, more preferably less than about 4 mm, still more preferably less than about 3 mm and most preferably between about 1 and 2.5 mm. Desirably the width of the central aperture is at least about 1.5 mm, more preferably at least about 2 mm, still more preferably at least about 3 mm to ensure that even in sewing machines and sergers with feed dogs of modest length, the feed dogs will continuously grasp at least two sections of the fabric not covered by the lower jaw as the assemblage of fabric and clamp passes under the presser foot thereby guarding against excessive slippage or puckering during the period in which the feed dogs are contacting the lower jaw of the clamp.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures:

FIG. 1-D schematically illustrates two pieces of fabric joined together by a clip of the present invention.

FIGS. 28, 29 and 30 are perspective views of the levers of the clamp of FIG. 1 illustrating alignment of protrusions with recesses maintaining the proper interrelationship between the levers as well as slots which the resilient stainless steel strip passes through in each, while

DESCRIPTION OF PREFERRED EMBODIMENTS

The invention is described in detail below with reference to several embodiments. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

With respect to the various ranges set forth herein, any upper limit recited may, of course, be combined with any lower limit for selected sub-ranges.

The transitional phrase "consisting essentially of" limits the scope of a claim to the specified materials or steps "and those that do not materially affect the basic and novel characteristic(s)" of the claimed invention. As used herein, "consisting essentially of" and like terminology refers to the recited components and excludes other components which would substantially change the basic and novel characteristics of the article. Unless otherwise indicated or readily apparent, an article consists essentially of the recited components when the article includes 90% or more of the recited components. That is, the terminology excludes more than 10% unrecited components.

Figure 1:
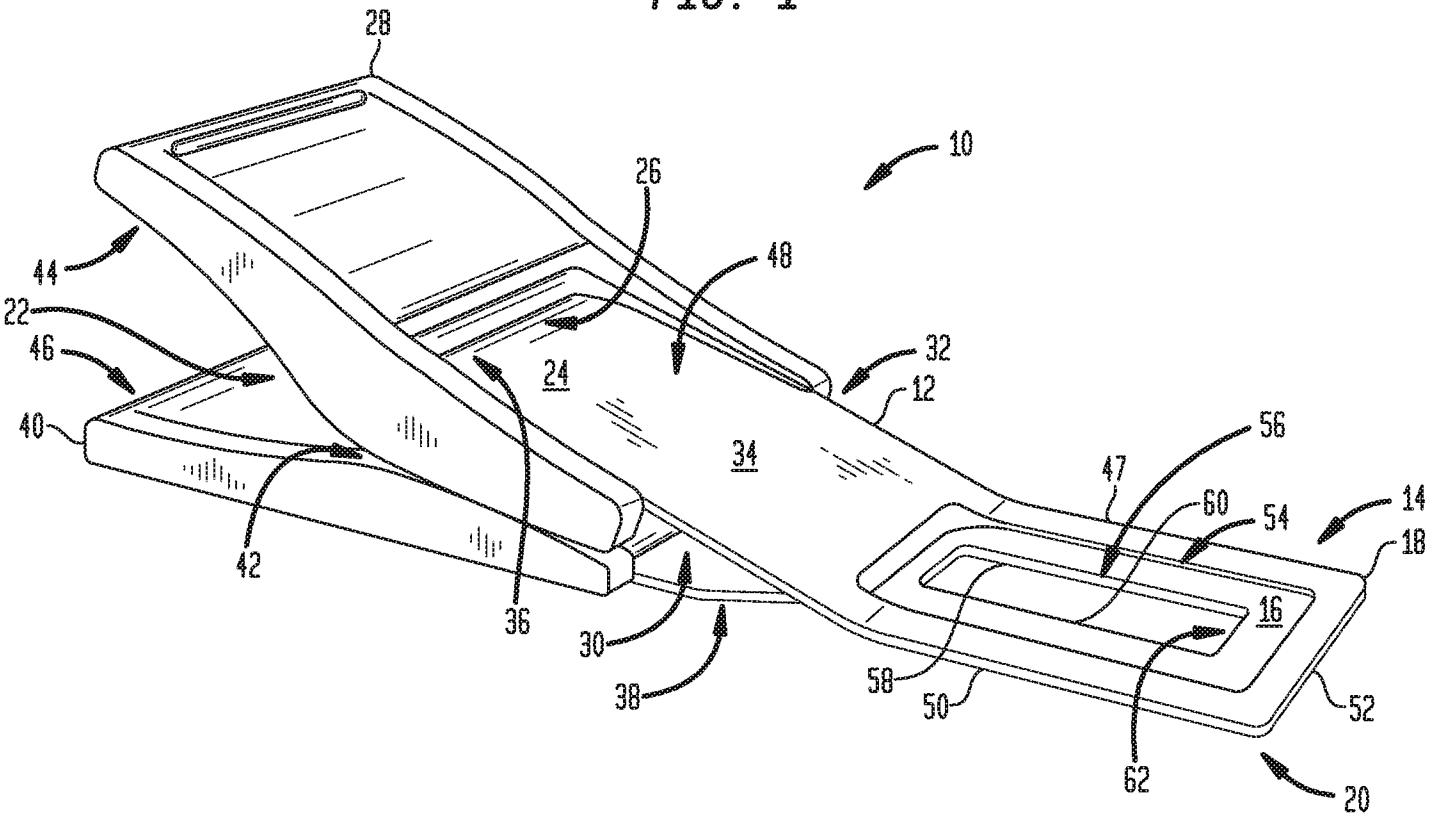
FIG. 1 illustrates a clamp of the present invention having plastic levers configured to facilitate separation of the upper and lower jaws of the clamp against the resilience of the steel.
Figure 46:
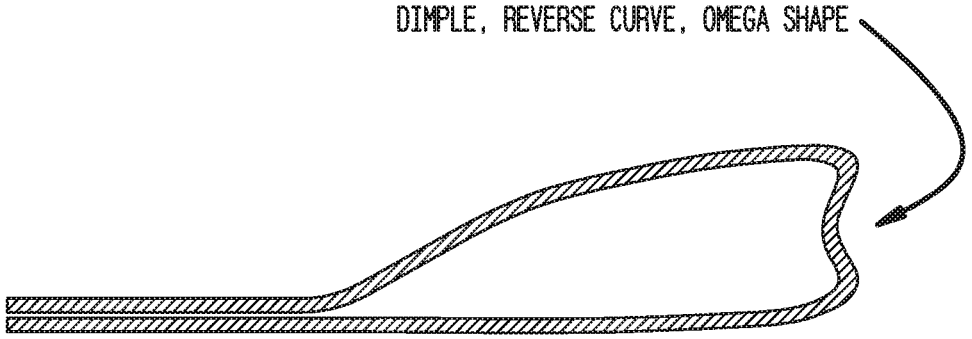
FIGS. 46 and 47 are schematic illustrations of alternative configurations of the curvilinear portion of the resilient metal strip.

In FIG. 1, clamp 10 is comprised of a thin sheet 12 of resilient stainless steel having generally planar jaws 14 and 16 formed at either end 18 and 20 of resilient stainless steel sheet 12 with U or ω portion 22 in between. Normally, I prefer to use a stainless steel strip 12 formed into an ω configuration as shown in FIG. 46 as this makes a more compact design; but either form of curvilinear portion 22 may be used. Upper portion 24 of said resilient strip 12 passes through slot 26 in upper lever 28 and engages lower surface 30 of upper portion 24 at location 32 between obtuse oblique 34 portion of upper portion 24 and curvilinear portion 22 whilst upper lever 28 engages upper surface 48 of resilient strip 12 at a location 36 between location 32 at which upper lever 28 engages lower surface 30 of upper portion 24 and lower portion 38 of resilient strip 12, upper lever 28 extending past curvilinear portion 22 whilst upper lever 28 and lower lever 40 bear against each other along transversely extending area 42 between curvilinear portion 22 of said resilient strip 12 and obtuse oblique 34; with portions 44 and 46 of upper lever 28 and lower lever 40 respectively extending beyond curvilinear portion 22 being spaced apart when upper jaw 14 and lower jaw 16 are in interjacent generally coplanar deployment and urgable apart against the resilience of curvilinear upper U or ω portion 22 to displace upper jaw 14 and lower jaw 16 from interjacent generally coplanar engagement. Upper jaw 14 comprises longitudinal arms 47 and 50 joined by header 52 forming window 54 into which lower jaw 16 interpenetrates with window 56 in lower jaw 16 being defined by longitudinally extending arms 58 and 60 joined by header 62.

Figure 1A:
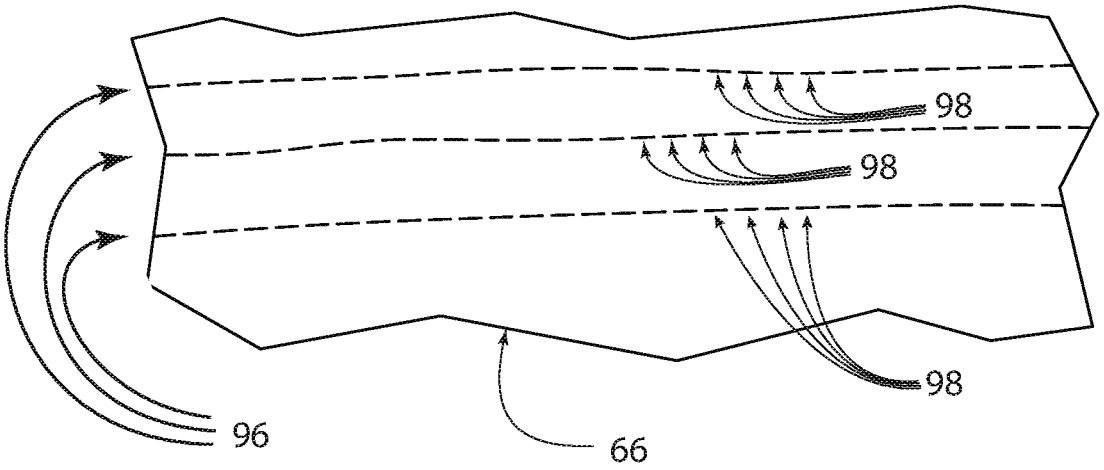
FIGS. 1A-1C schematically illustrate differences between stitches resulting as a clip of the present invention passes under a presser foot, FIG. 1A, as compared to stitches formed as clips not of the present invention pass under a presser foot.
Figure 1B:
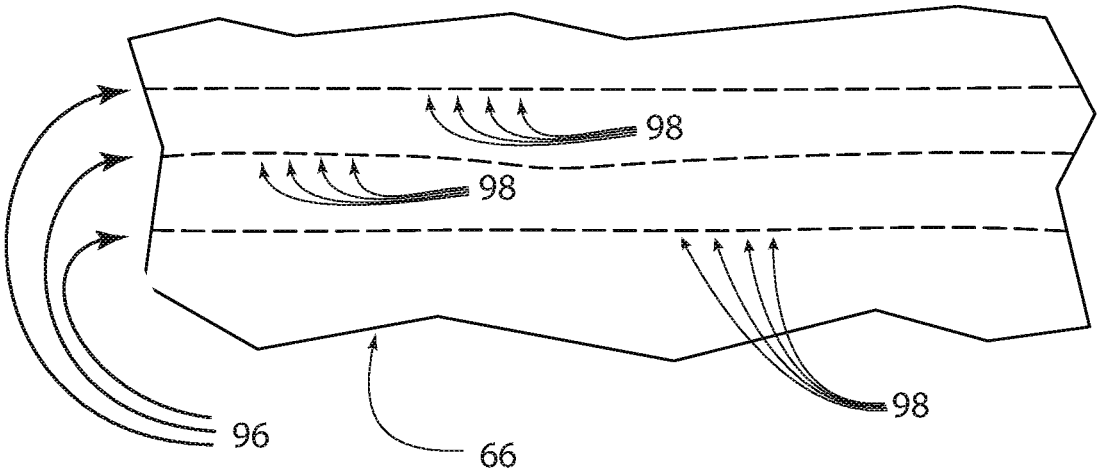
Figure 1C:
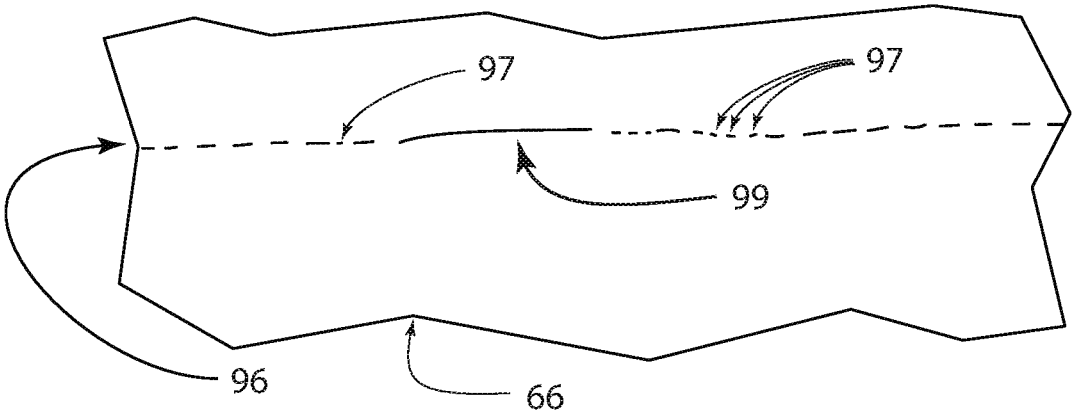

FIGS. 1A-1C schematically illustrate differences between stitches resulting as a clip of the present invention passes under a presser foot, FIGS. 1A and 1B, as compared to stitches formed as clips not of the present invention pass under a presser foot FIG. 1C. In particular, in fabric 66 three lines 96 of stitches 98 are formed across fabric 66 with each stitch 98 being of substantially the same length and generally collinear with each other. This is possible when the total thickness of jaws 14 and 16 with fabric 66 gripped therebetween is such that clip 10 having dimensions as prescribed herein is able to pass under the presser foot without puckering, slipping or sticking. In contrast in FIG. 1C, line 96 of stitches 98 illustrates the result when fabric 66 either sticks—does not advance by the usual feed per stitch of the machine—and accordingly small, uneven stitches 97 are formed or fabric 66 surges—advances by more than the usual feed per stitch—in which case missed stitch 99 is formed.

Figure 1D:
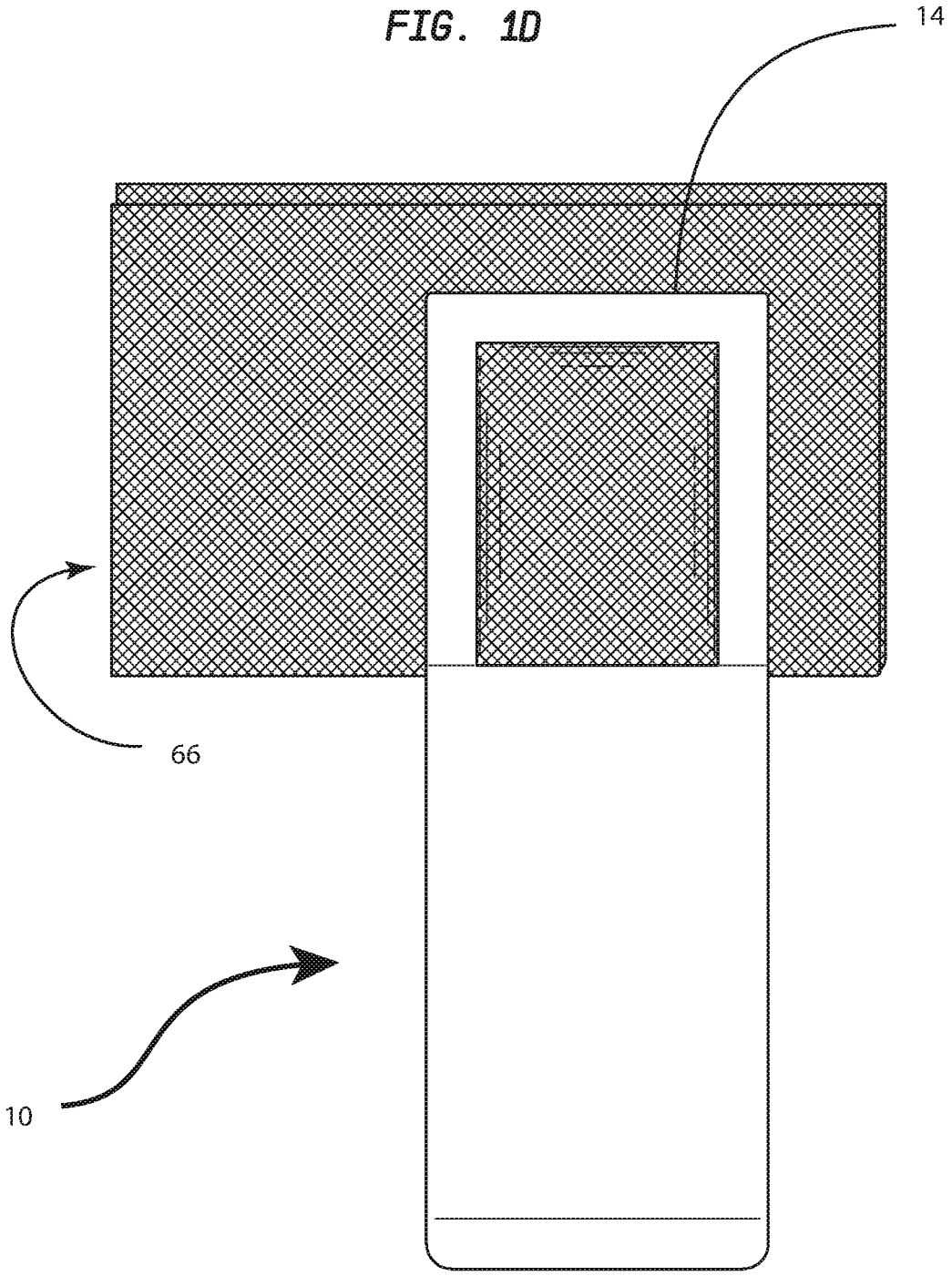

FIG. 1D schematically illustrates two pieces of fabric 66 joined together by clip 10 of the present invention grasping fabric 66 between upper jaw 14 and lower jaw 16 concealed in this Figure by fabric 66.

Figure 2:
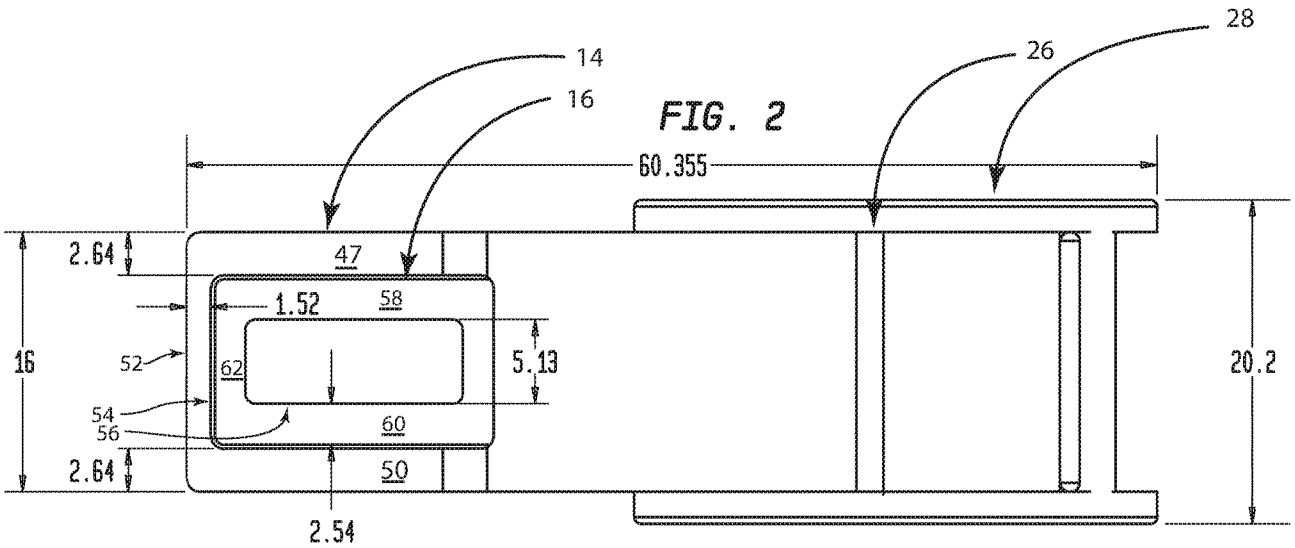
FIGS. 2 and 3 illustrate a highly preferred configuration of a large clamp of the present invention having levers for forcing the jaws apart wherein the dimensions are chosen such that an assemblage of fabric held together by the clamps of the present invention will pass under presser foot whilst forming a seam of high quality—preferably without puckers or skipped stitches and most advantageously without jamming.
Figure 3:
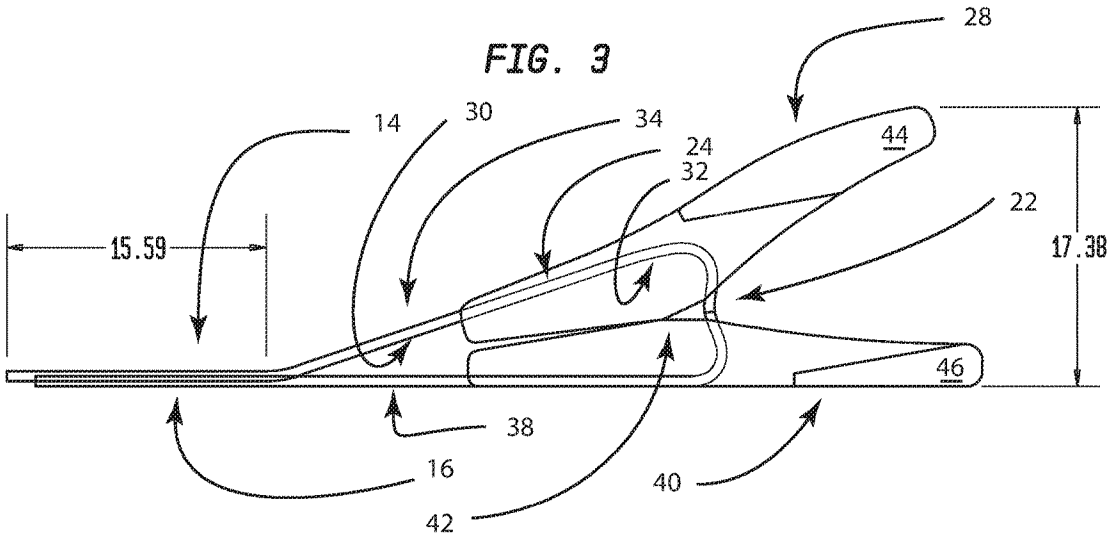
Figures 6, 7, 8, 9:
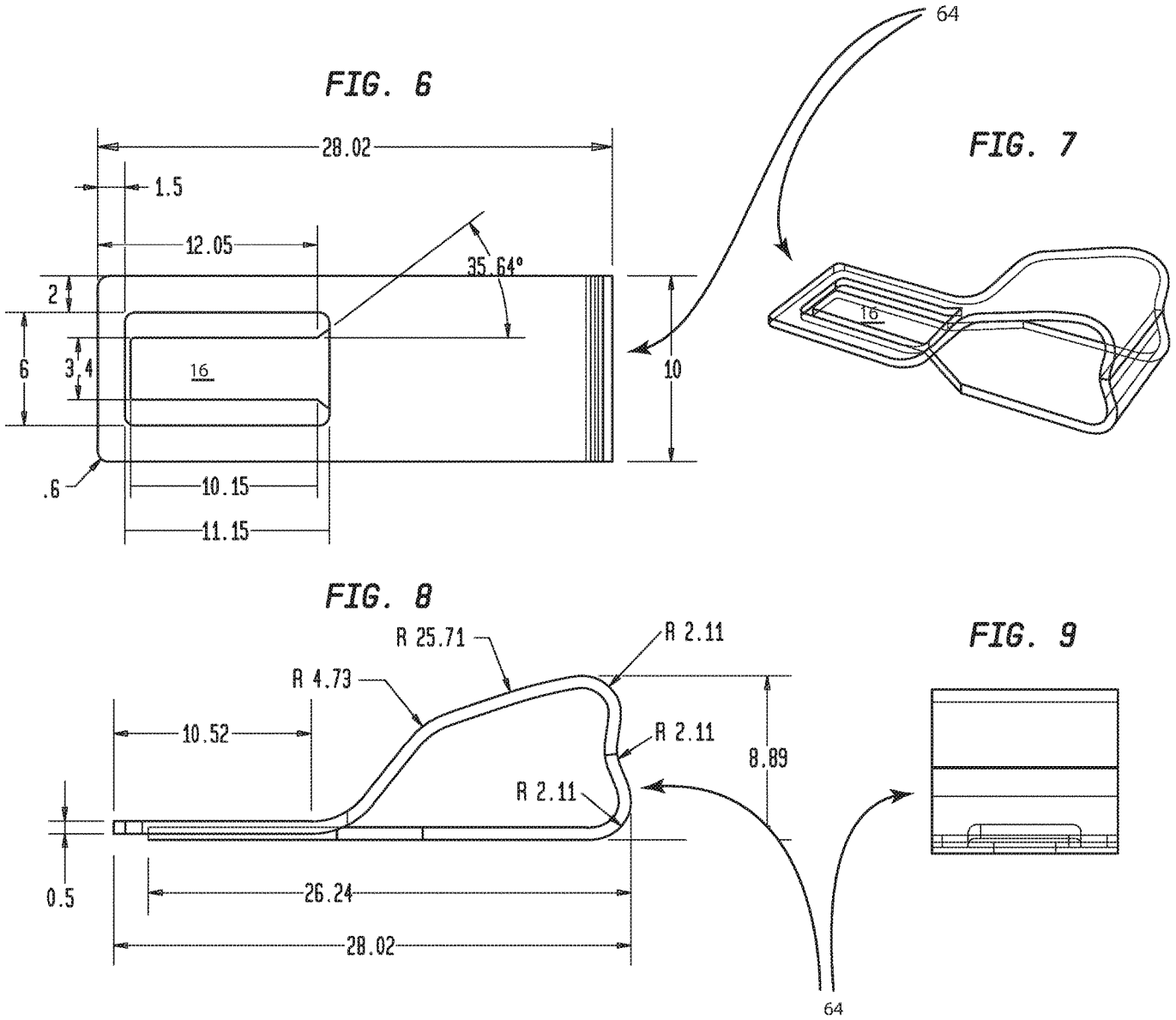
FIGS. 6-9 illustrate the most preferred dimensions for one small clamp of the present invention having a "tongue" type of lower jaw. In this case, the levers are not shown but are substantially as shown in FIGS. 2 and 3.

FIGS. 2 and 3 illustrate highly preferred dimensions for large clamp 10 of the present invention having levers 28 and 40 for forcing jaws 14 and 16 apart. Investigations with several popular sewing machines indicate that smooth passage under the presser foot is limited primarily by the maximum width of the portions of the lower jaw interposed between the fabric and the throat plate of the sewing machines. In particular, it appears that when only a single tongue is interposed between the fabric and the throat plate of the sewing machine, smooth passage is highly assured when the width of the tongue is less than about 3.5 mm with passage becoming less certain but still probable as the width of the tongue is increased to 4 mm, and is still less certain at 5 mm and usually becomes problematic as the width of the tongue is increased beyond 6 mm. The best results are obtained when the width of the tongue is about 2.2 mm or less. When the lower jaw takes the form of a frame having lateral sides, similar smooth passage guidelines apply to the width of each arm of the frame whilst excellent results are obtained when the width of the arms are about 2.54 mm or less with best results when the width is about 1.5 mm or less. Even though the same strictures do not apply to the upper jaw and indeed the top jaw can have considerable width without unduly interfering with smooth passage, I greatly prefer the window within a window configuration of FIGS. 2 and 4 or tongue within a window configuration of FIG. 6 as it enables me to reduce the overall height of the assemblage. When the window within a window configuration is used, it is highly advantageous that the width of the window be about 1 mm or more and even better if the width is about 1.5 mm or 2 mm as the feed dogs of the machine have more fabric to grip between the interruption occasioned by the arms of the frame. The width of the aperture may beneficially be increased to 3, 4 or 6 mm or more without interfering with the ability to pass under the presser foot. I prefer the window in window construction as it makes it possible to decrease the height of the assemblage of the jaws and fabric as it passes under the presser while reducing length of interruptions occasioned by the arms of the inner frame while substantially retaining the clamping force that would be occasioned by a single tongue having the combined width of the arms of the frame. Conceptually, of course, the solid tongue in a window configuration is merely a special case of the window within a window configuration wherein the width of the window is nil. Throughout this specification and claims, where the terms "lateral" and "transverse" are used, they should be understood to refer to the direction perpendicular to the long axis of the clamp and parallel to the motion of the fabric as it passes under the presser foot of the sewing machine.

Figure 4:
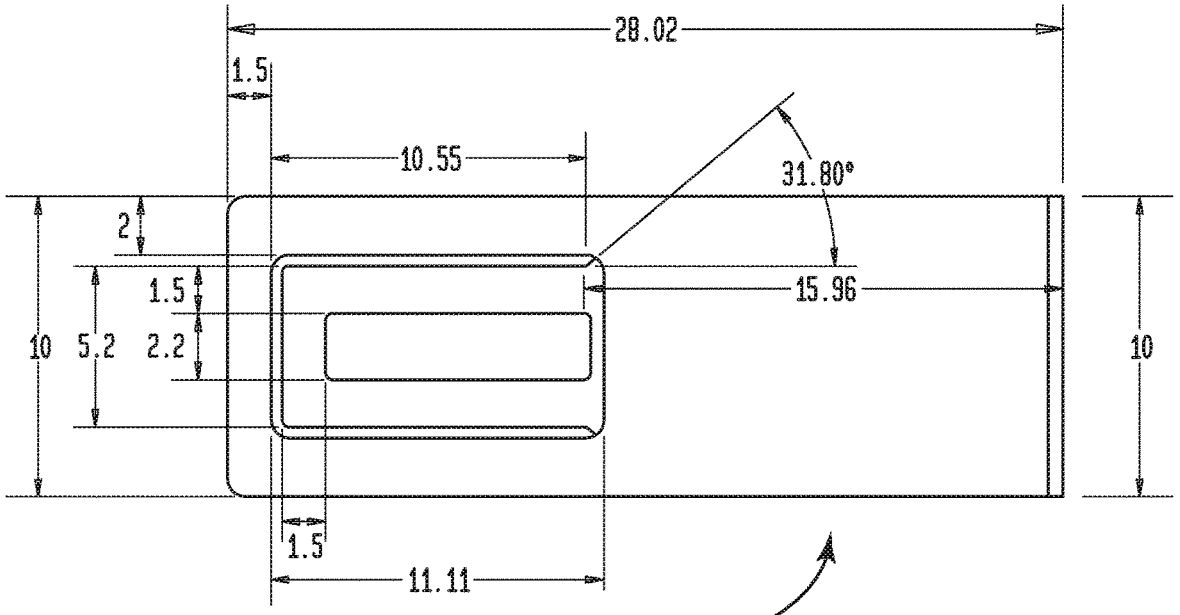
FIGS. 4 and 5 illustrate highly preferred dimensions for one small clamp of the present invention having a "window" type of lower jaw. In this case, the levers are not shown but are substantially as shown in FIGS. 2 and 3.
Figure 5:
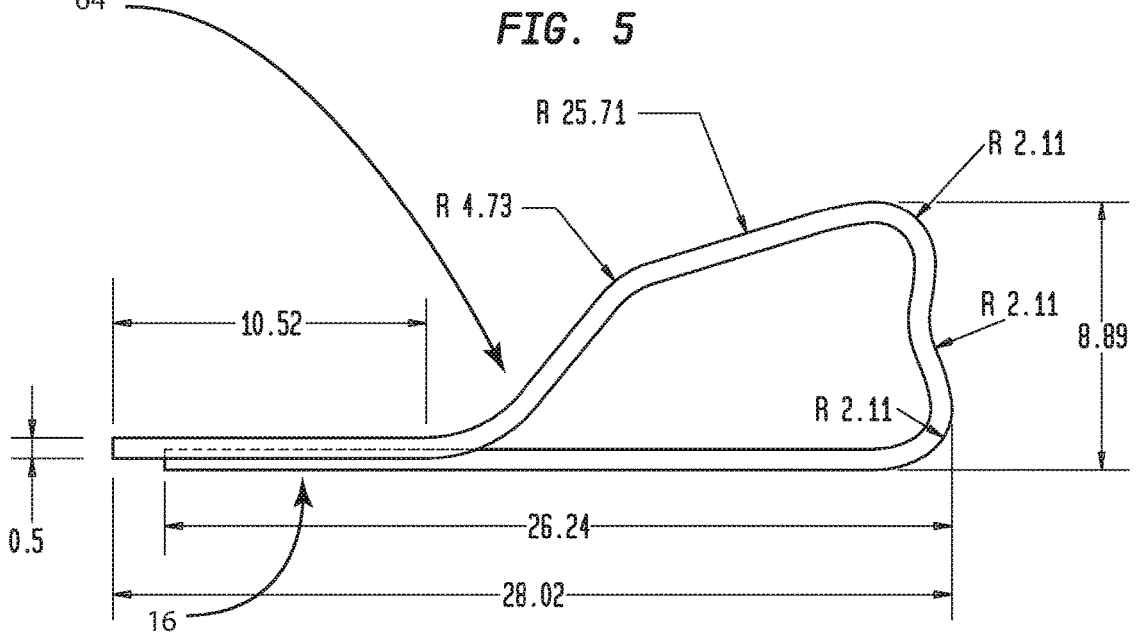

FIGS. 4 and 5 illustrate highly preferred dimensions for small clamp 64 of the present invention having "window" type lower jaw 16. In this case, the levers are not shown but are substantially as shown in FIGS. 2 and 3.

FIGS. 6-9 illustrate the most preferred dimensions for small clamp 64 of the present invention having a "tongue" type of lower jaw 16. In this case, the levers are not shown but are substantially as shown in FIGS. 1, 2 and 3.

All dimensions in FIGS. 2-9 are shown in millimeters, with the exception of angles measured in degrees, which are accordingly marked (i.e., "°").

Figure 10:
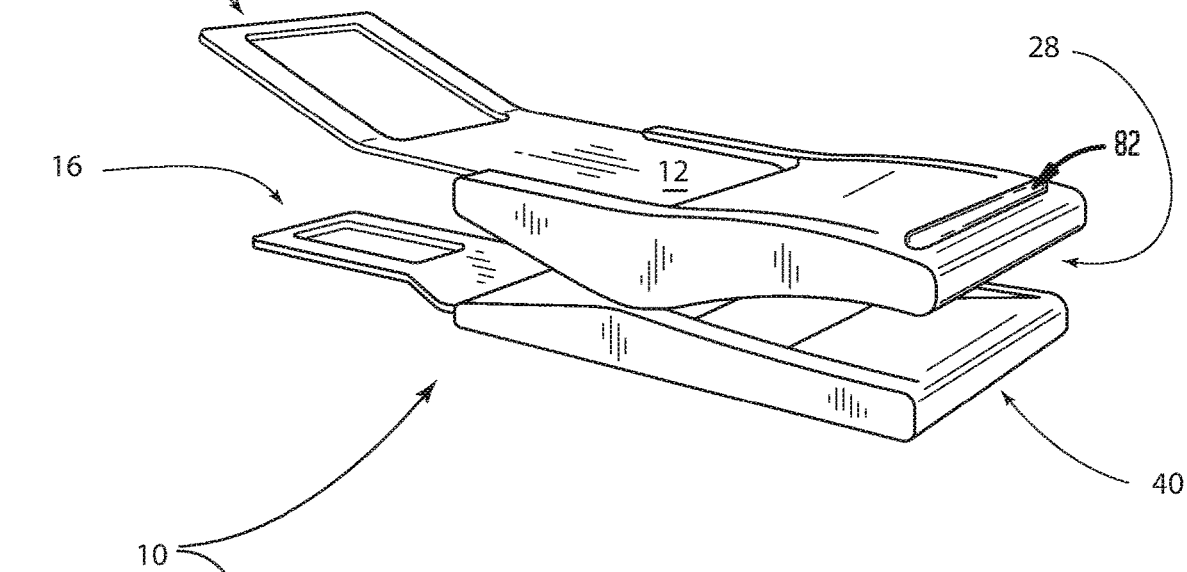
FIG. 10 illustrates a clamp of the present invention as shown in FIG. 1 in which the plastic levers configured to facilitate separation of the upper and lower jaws of the clamp against the resilience of the steel have been urged together separating the upper and lower jaws so that fabric may be inserted therebetween and thereafter clamped by removal of the pressure applied to the levers.

FIG. 10 illustrates clamp of the present invention 10 as shown in FIG. 1 in which plastic levers 28 and 40 configured to facilitate separation of upper jaw 14 and lower jaw 16 of clamp 10 against the resilience of resilient stainless steel strip 12 have been urged together separating upper jaw 14 and lower jaw 16 so that fabric 66 may be inserted therebetween and thereafter clamped by removal of pressure applied to levers 28 and 40.

Figure 11:
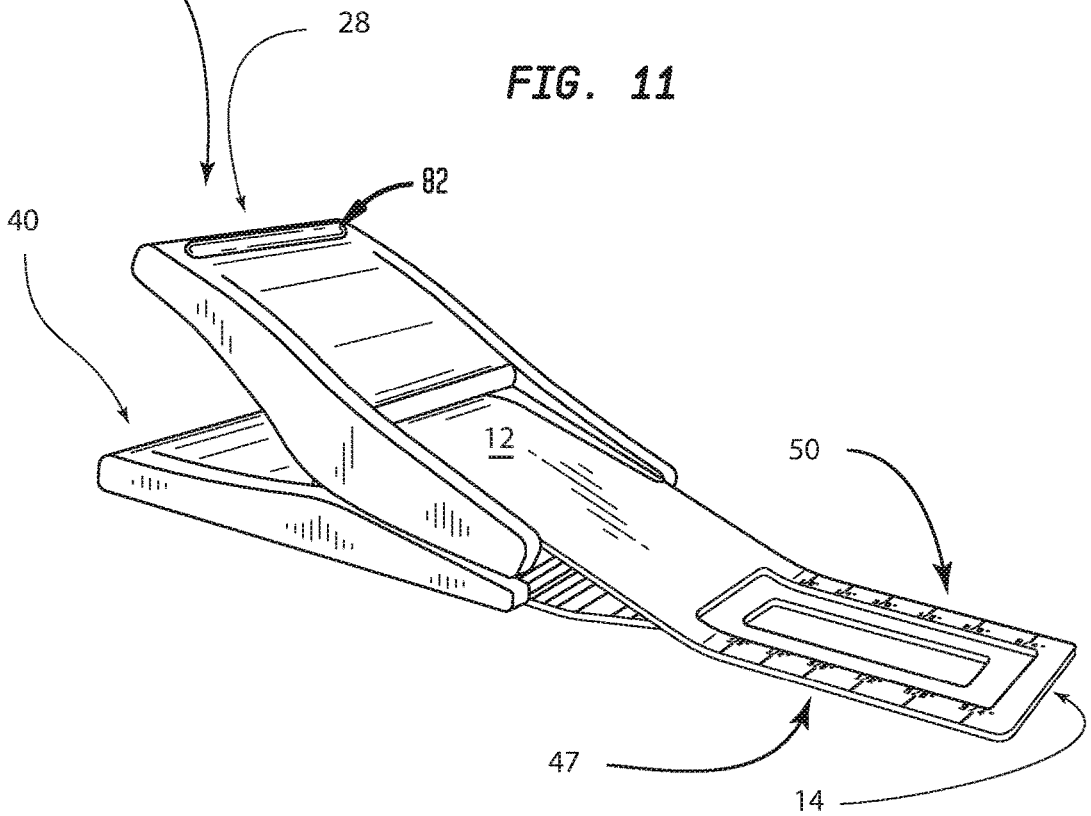
FIGS. 11 and 12 illustrate clamps of the present invention having scale markings engraved on the frame of the upper jaw to allow the seamstress to control the width of seams more precisely.
Figure 12:
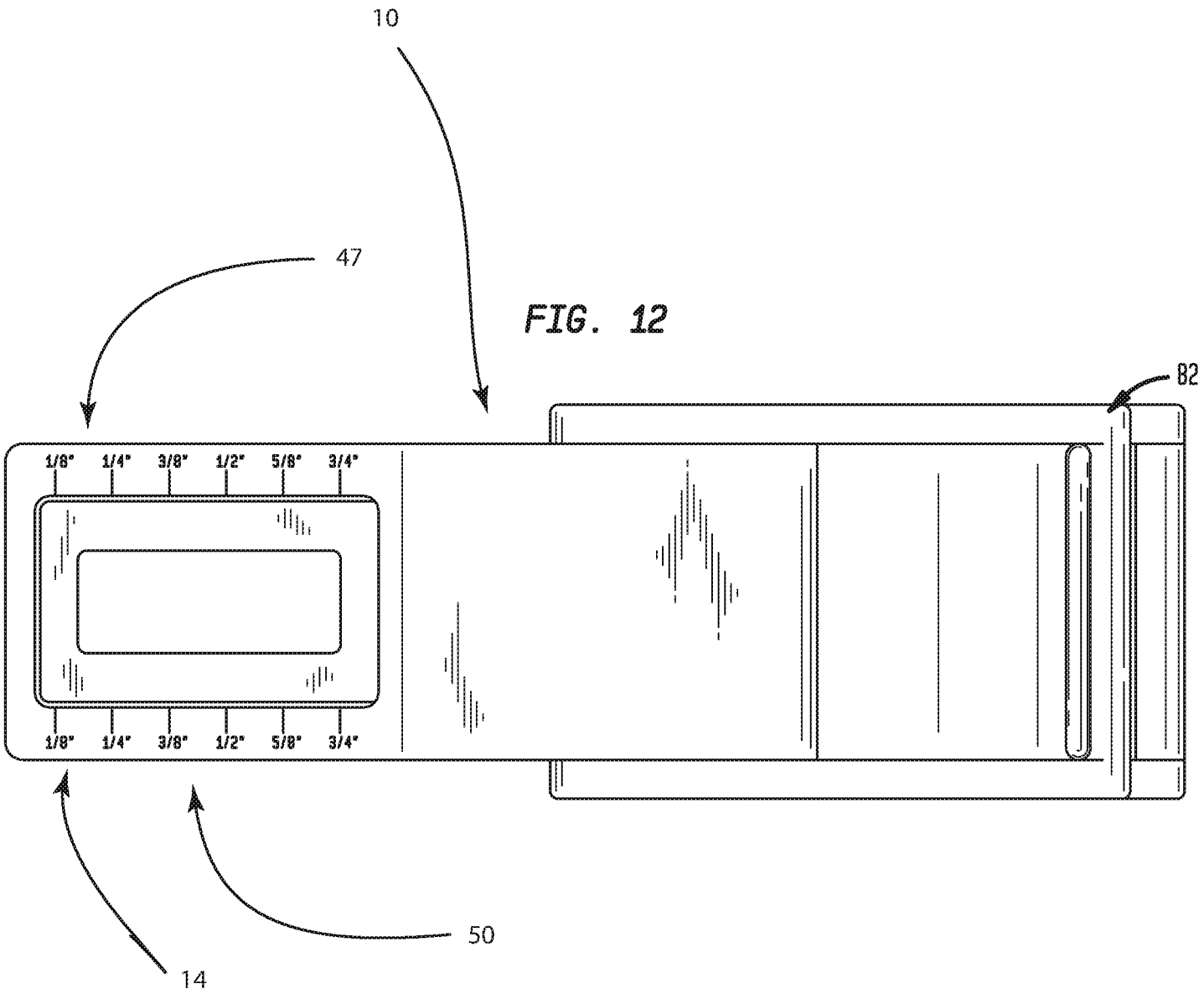

FIGS. 11 and 12 illustrate clamps of the present invention 10 having scale markings engraved on longitudinally extending arms 47 and 50 of upper jaw 14 to allow the seamstress to control the width of seams more precisely.

Figure 13:
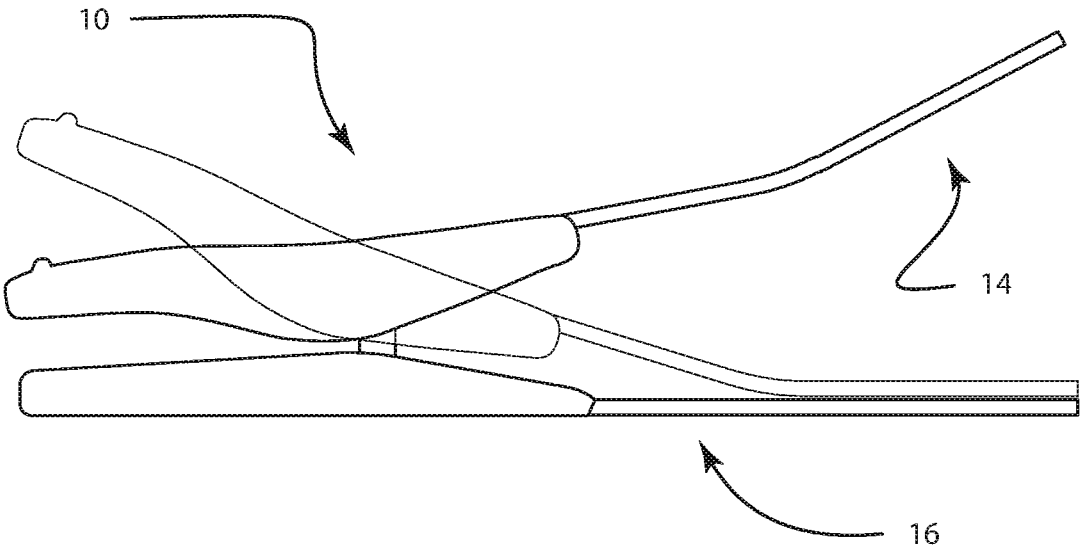
FIG. 13 illustrates a side view of a clamp of the present invention as shown in FIG. 1 in the open position with a phantom view of the upper jaw in the closed position superposed thereover to illustrate the action of the levers and opening and closing the jaw of the clamp.

FIG. 13 illustrates a side view of clamp 10 of the present invention as shown in FIG. 1 in the open position with a phantom view of the upper jaw 14 in the closed position superposed thereover to illustrate the action of the levers and opening and closing the jaw of the clamp.

Figure 14:
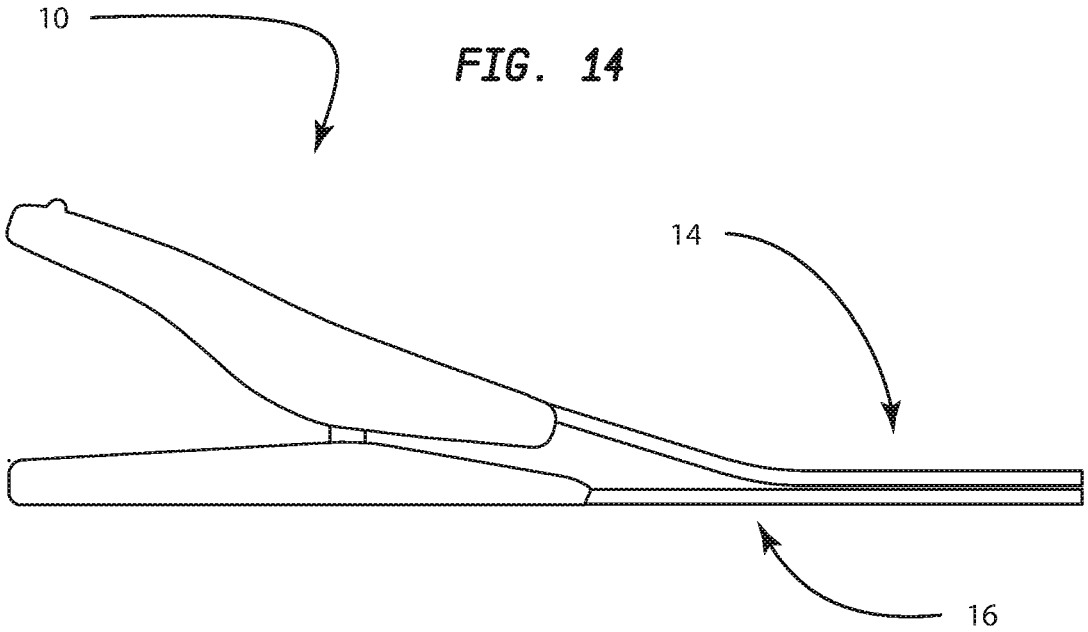
FIG. 14 illustrates a side view of a clamp of the present invention as shown in FIG. 1 in the closed position to illustrate the extreme thinness of the jaw of the clamp. Note that even though the jaws preferably interpenetrate when closed; in this Figure, they are shown stacked as might be occasioned by relatively stiff fabric therebetween.

FIG. 14 illustrates a side view of clamp 10 of the present invention as shown in FIG. 1 in the closed position to illustrate the extreme thinness of jaws 14 and 16 of clamp 10. Note that even though jaws 14 and 16 interpenetrate when closed without fabric 66 therebetween, in this FIG. 14 they are shown stacked as might be occasioned by relatively stiff fabric 66 therebetween.

Figure 15:
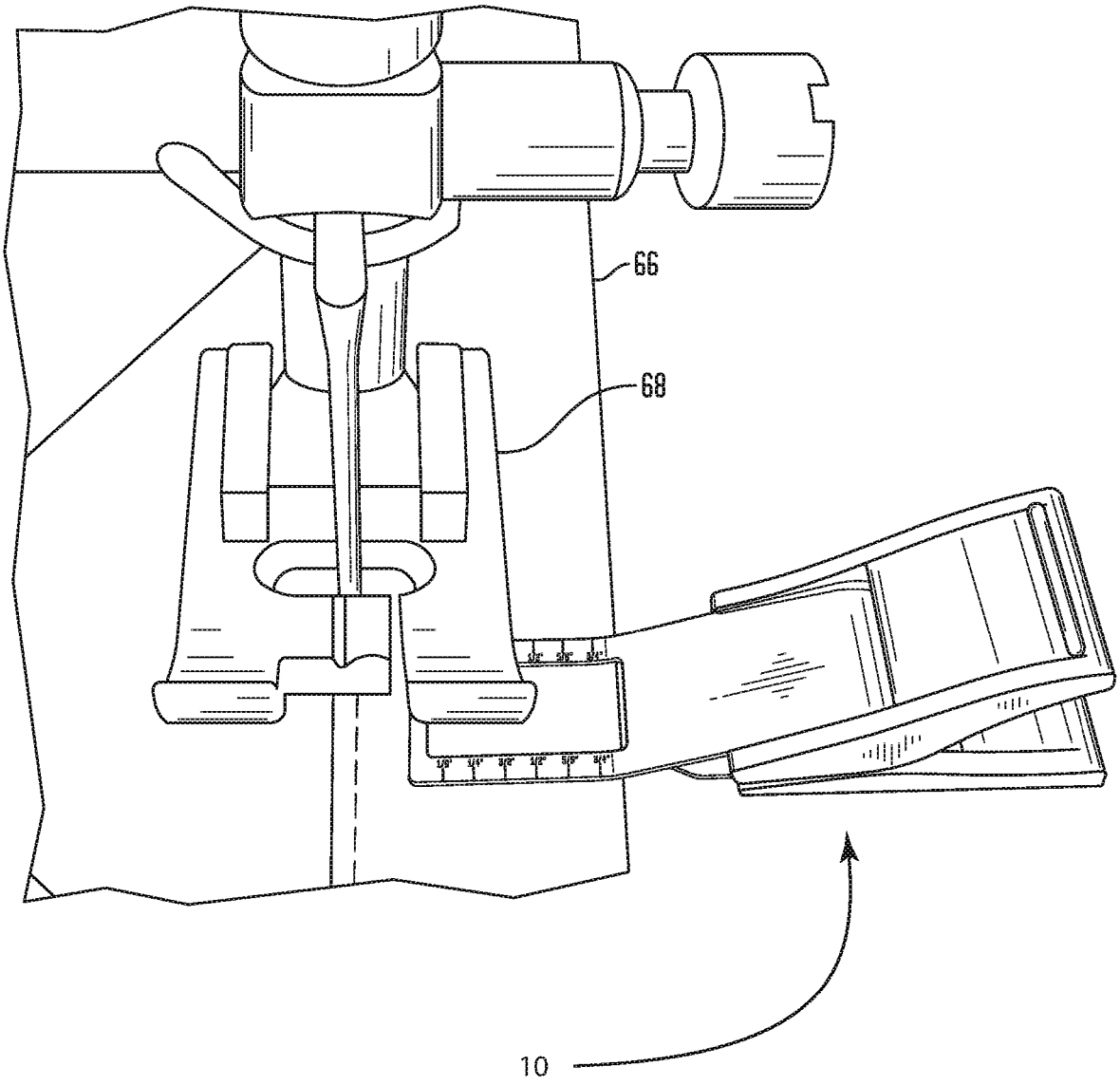
FIG. 15 illustrates a clamp of the present invention passing under the presser foot of a sewing machine whilst holding fabric in place for precise formation of a seam.

FIG. 15 illustrates clamp 10 of the present invention passing under the presser foot 68 of a sewing machine while holding fabric 66 in place for precise formation of a seam.

Figure 16:
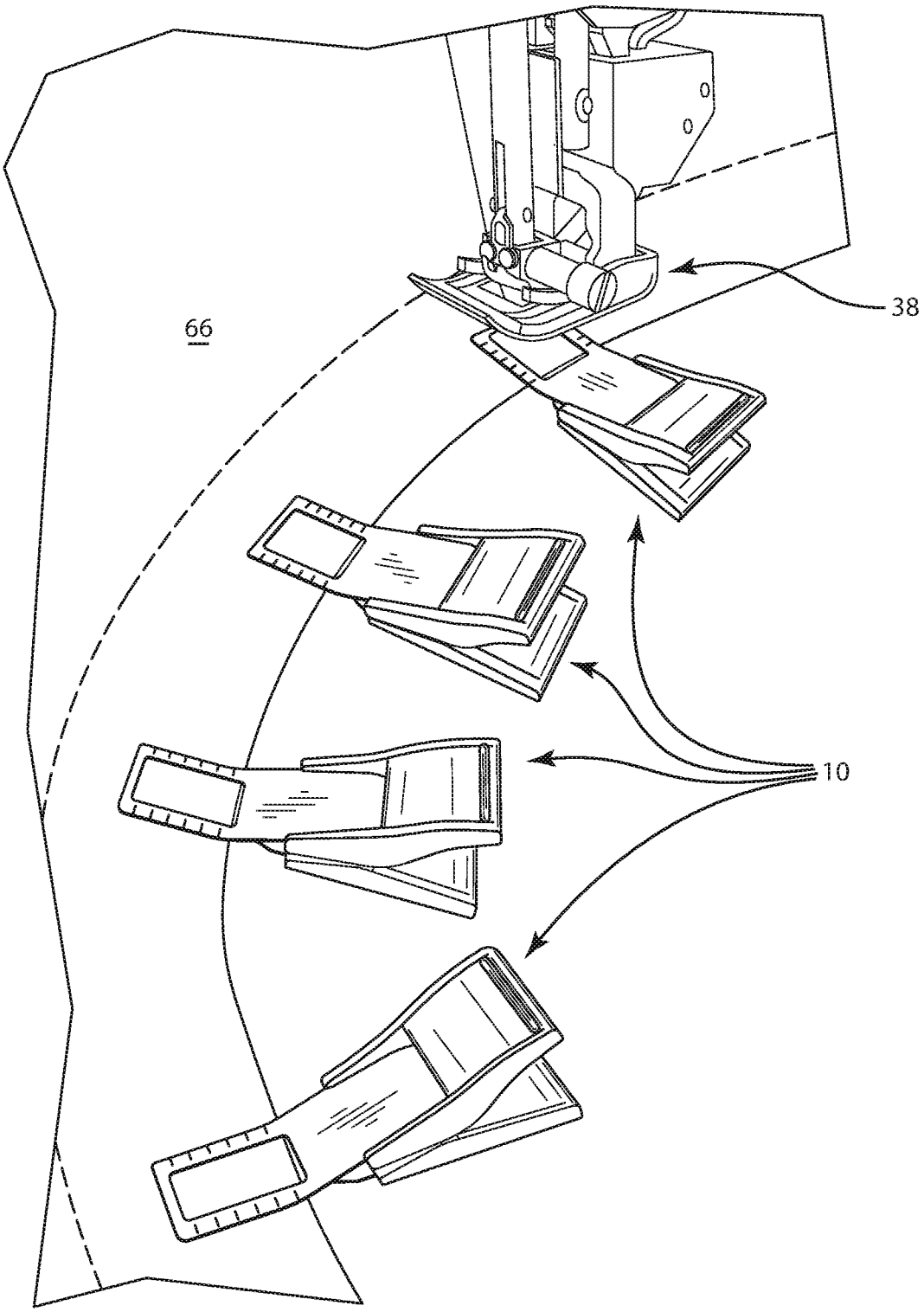
FIG. 16 illustrates how a multiplicity of clamps may be positioned and left in place during a prolonged period of the sewing process to more conveniently define a complex seam.

FIG. 16 illustrates how a multiplicity of clamps 10 may be positioned and left in place during a prolonged period of the sewing process to more conveniently define a complex seam.

Figure 17:
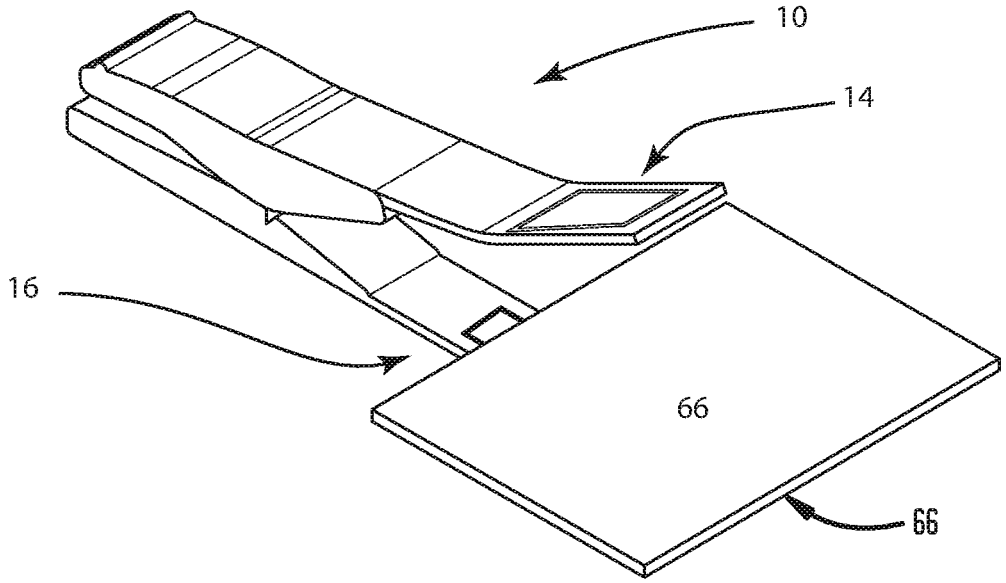
FIGS. 17 and 18 illustrate clamping of fabric in the jaws of the clamp of the present invention.
Figure 18:
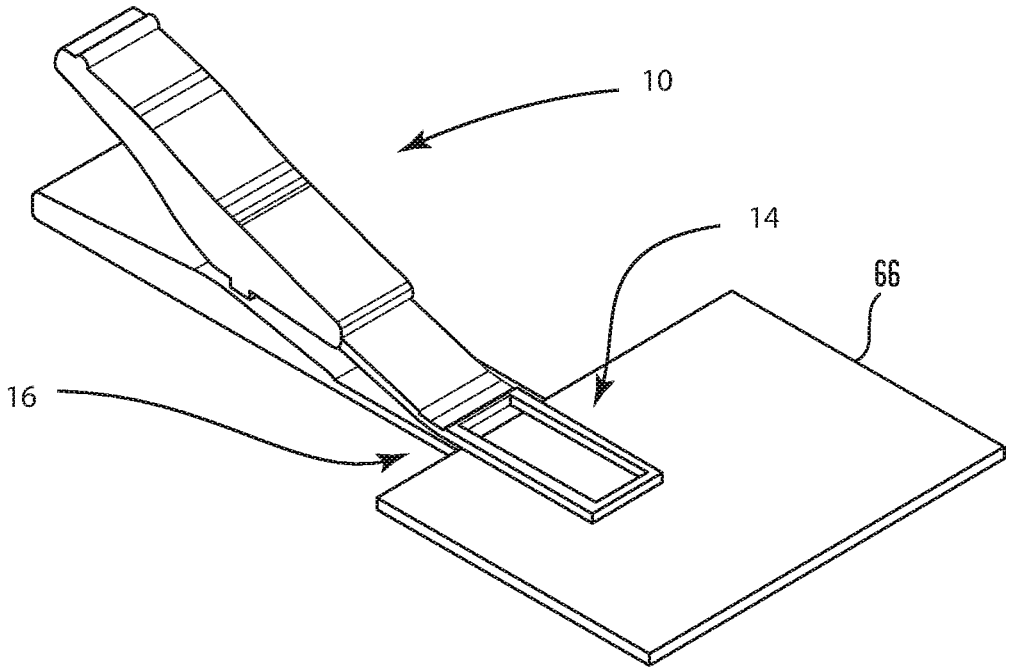

FIGS. 17 and 18 illustrate clamping of fabric 66 in jaws 14 and 16 of clamp 10 of the present invention.

Figure 19:
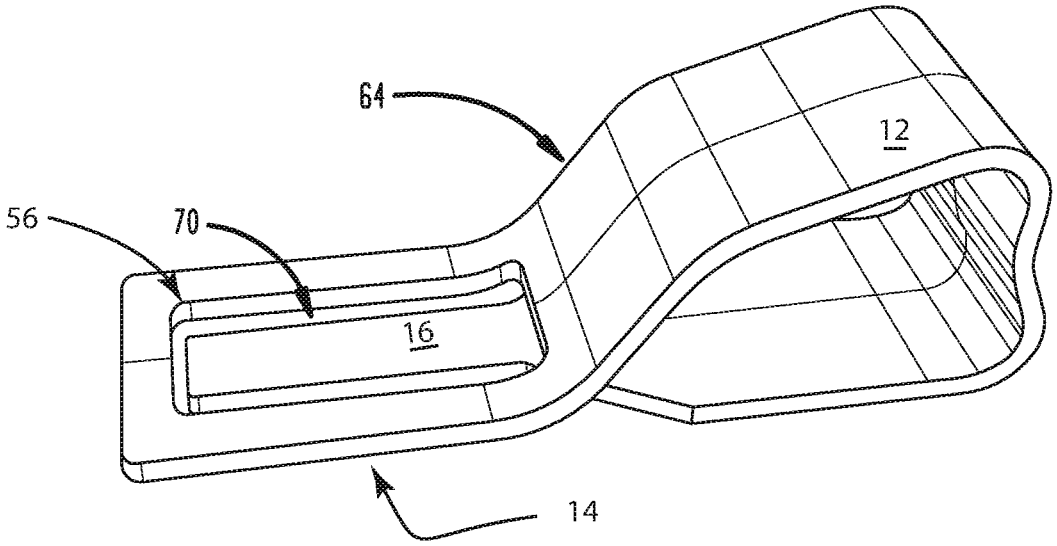
FIGS. 19 and 20 are perspective views illustrating the metal portion of a small clamp of the present invention in which the lower jaw takes the form of a tongue protruding into the window defined by the upper jaw.
Figure 20:
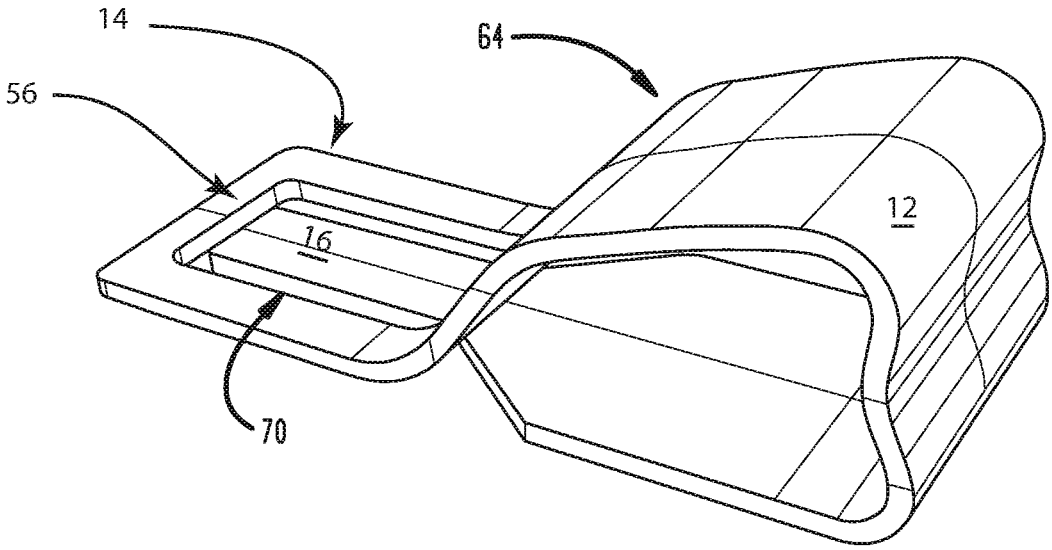

FIGS. 19 and 20 are perspective views illustrating metal sheet 12 of small clamp 64 of the present invention in which lower jaw 16 takes the form of tongue 70 protruding into window 56 defined by upper jaw 14.

Figure 21:
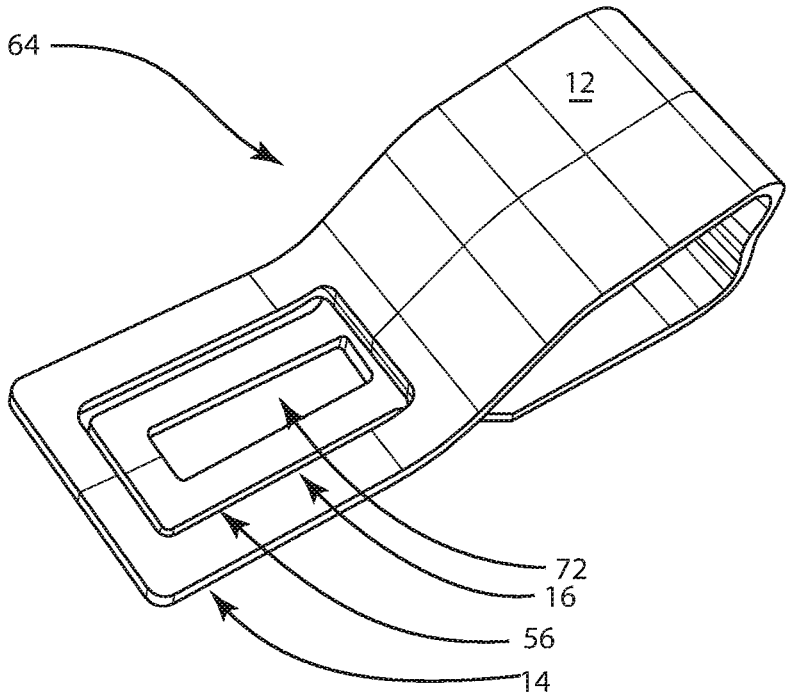
FIGS. 21 and 22 are perspective views illustrating the metal portion of a small clamp of the present invention in which the lower jaw takes the form of a window protruding into the window defined by the upper jaw.
Figure 22:
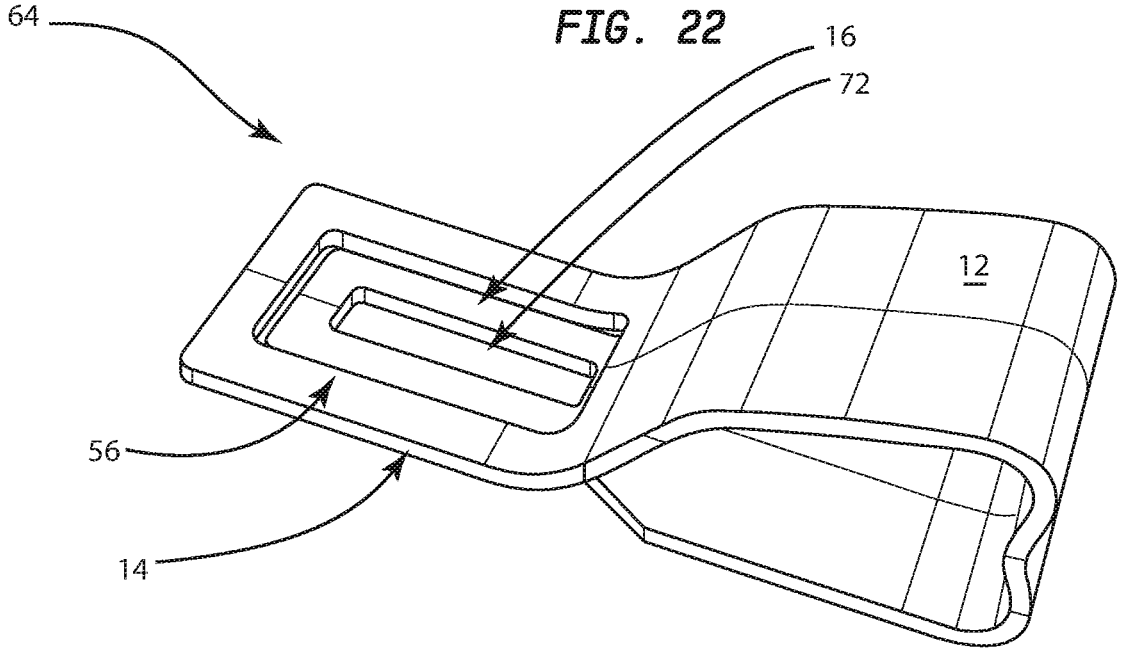

FIGS. 21 and 22 are perspective views illustrating metal sheet 12 of small clamp 64 of the present invention in which lower jaw 16 takes the form of window 72 protruding into window 56 defined by upper jaw 14.

Figure 23:
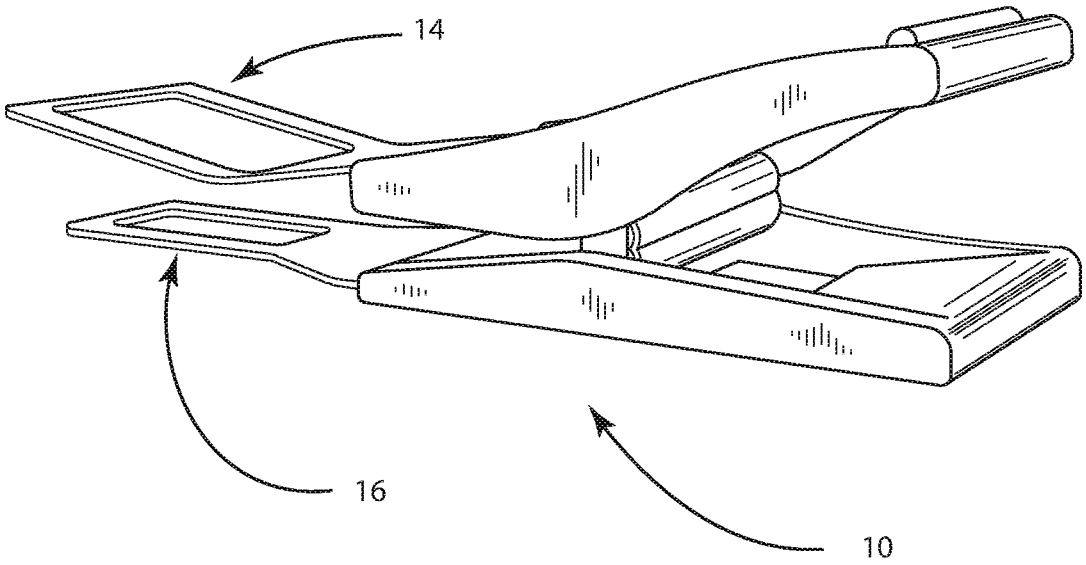
FIGS. 23 and 24 are perspective views of the clamp of FIG. 1 with the jaws being urged apart.
Figure 24:
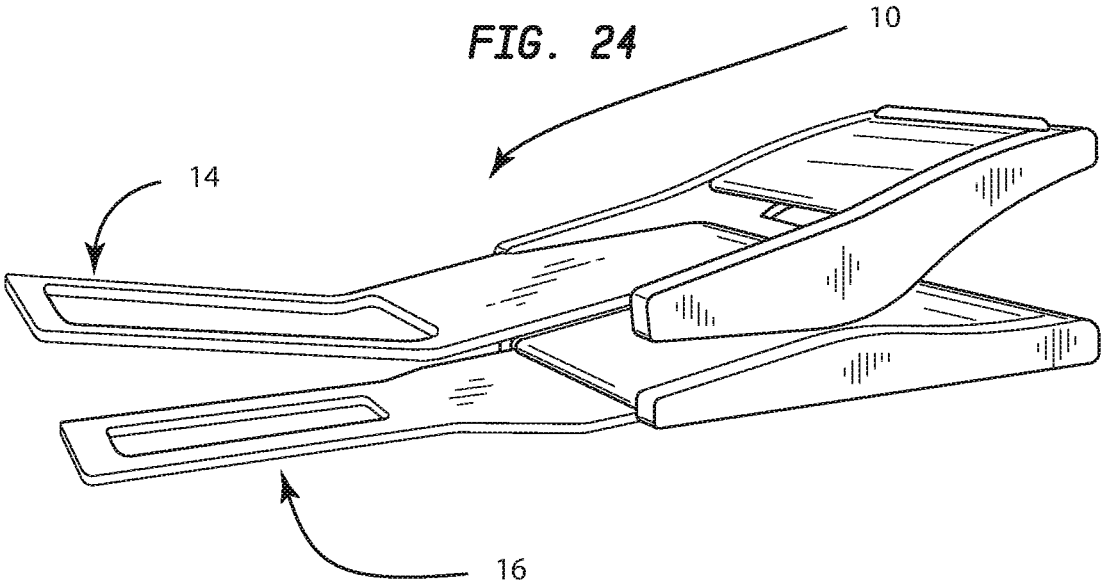

FIGS. 23 and 24 are perspective views of clamp 10 of FIG. 1 with jaws 14 and 16 being urged apart.

Figure 25:
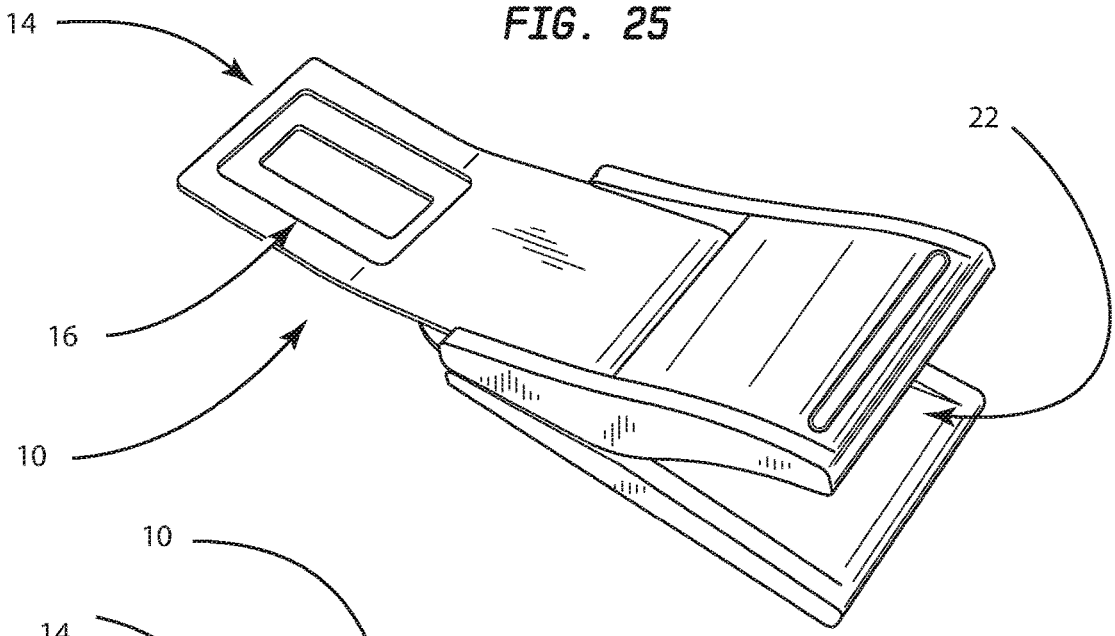
FIGS. 25-27 illustrate perspective views of the clamp of FIG. 1 with the jaws being urged together by the resilience of the metal in the U of the clamp.
Figure 26:
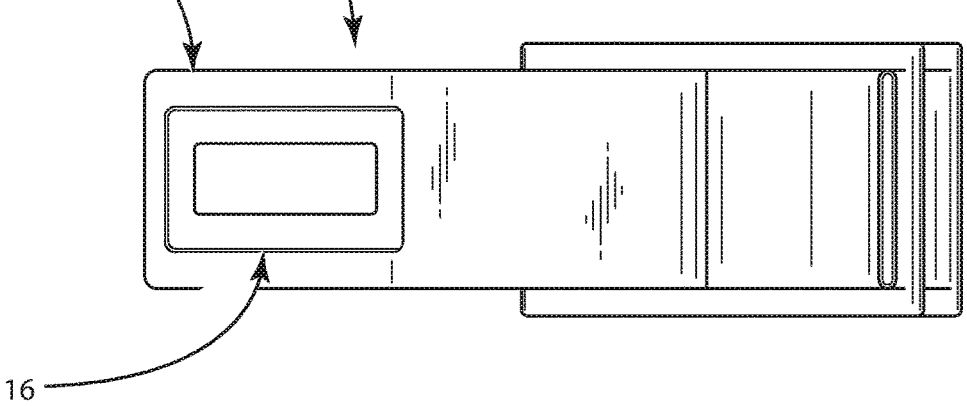
Figure 27:
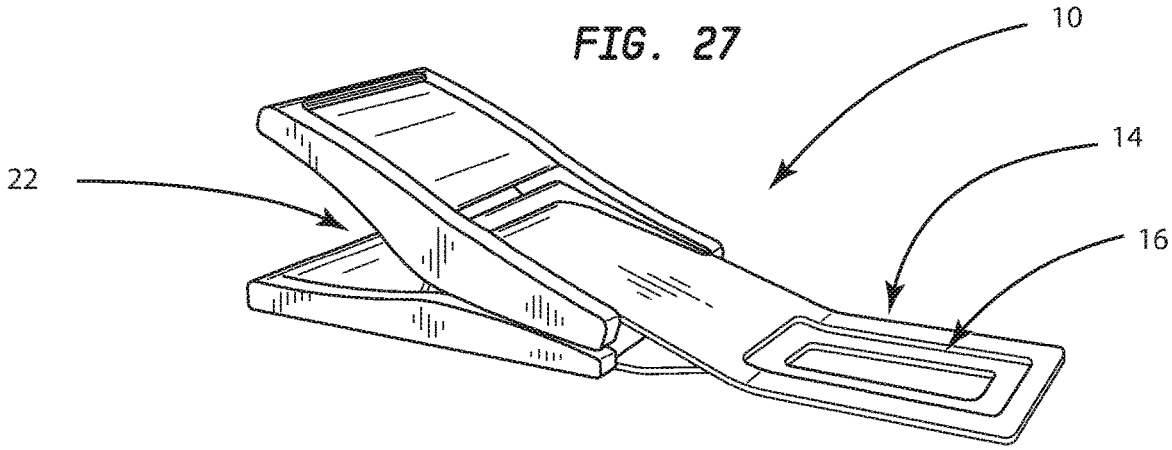

FIGS. 25-27 illustrate perspective views of clamp 10 of FIG. 1 with jaws 14 and 16 being urged together by the resilience of resilient stainless steel strip 12 in U 22 of clamp 10.

Figure 30:
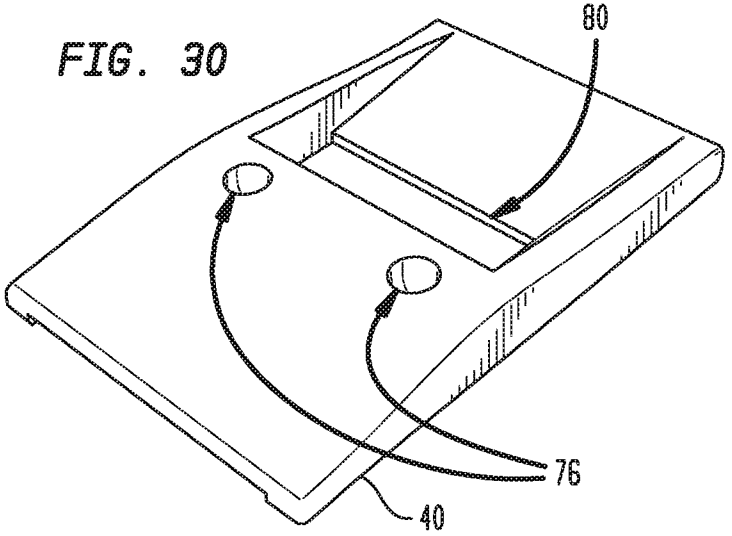
Figure 28:
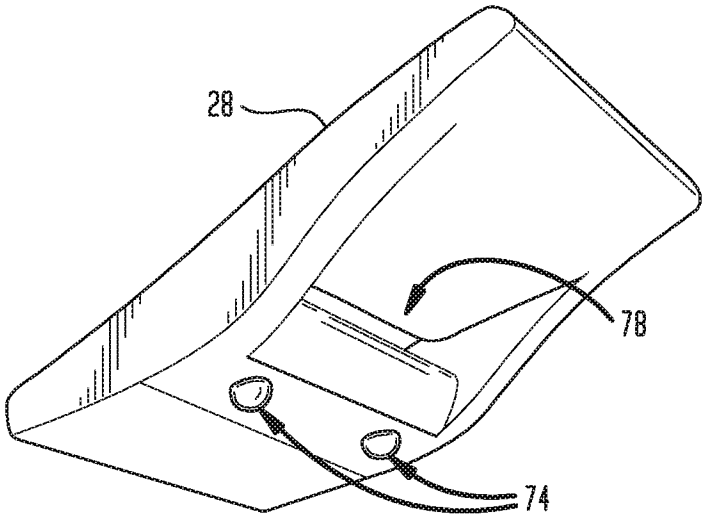
Figure 29:
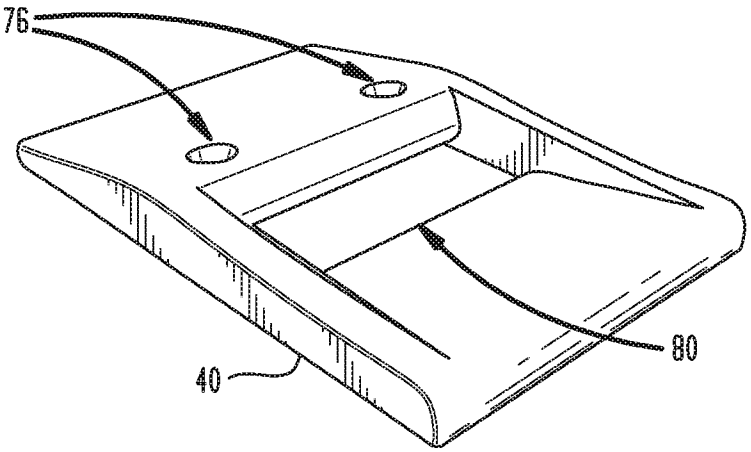

FIGS. 28, 29 and 30 are perspective views of upper and lower levers 28 and 40 of clamp 10 of FIG. 1 illustrating alignment protrusions 74 and alignment recesses 76 maintaining the proper interrelationship between levers 28 and 40 as well as slots 78 and 80 which resilient stainless steel strip 12 passes through in each.

Figure 31:
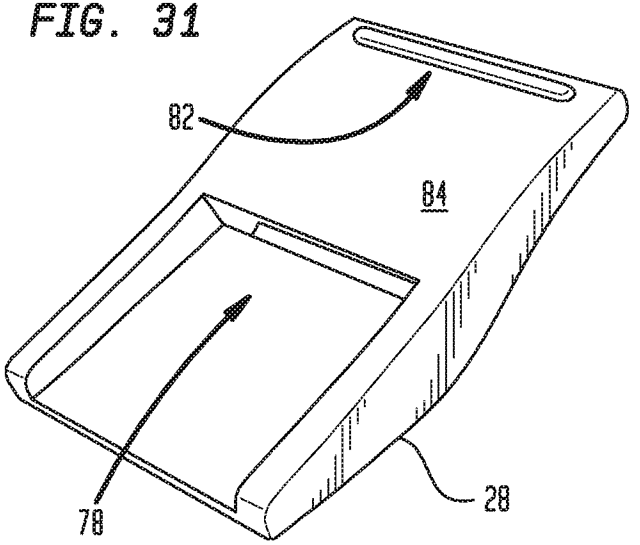
FIG. 31 illustrates the gripping ridge on the upper surface of upper lever facilitating grasp upon the upper lever.

FIG. 31 illustrates gripping ridge 82 on upper surface 84 of upper lever 28 facilitating grasp upon upper lever 28.

Figure 32:
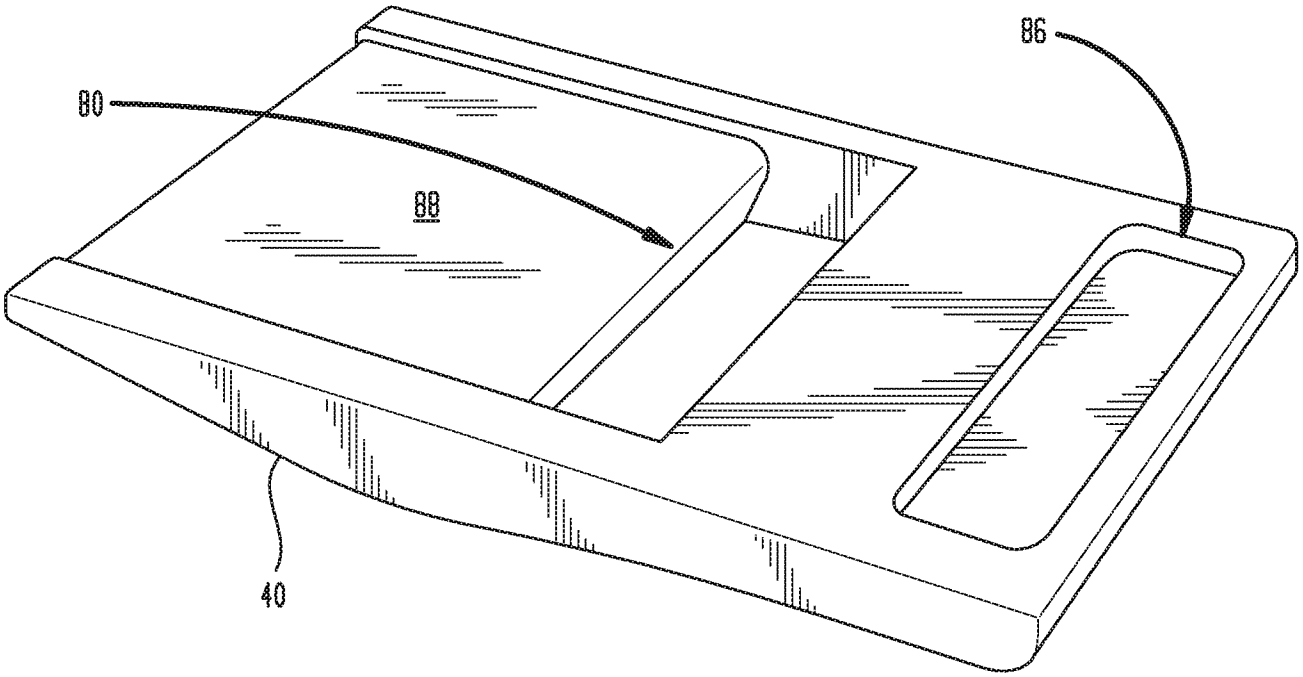
FIG. 32 illustrates the gripping recess on the lower surface of lower lever facilitating grasp upon the lower lever.
Figure 33:
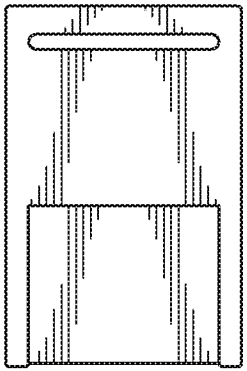
FIGS. 33-38 are plan view, left elevation, front elevation, lower surface, right elevation and rear elevation views of the upper lever.
Figure 35:
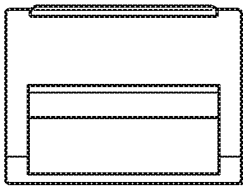
Figure 36:
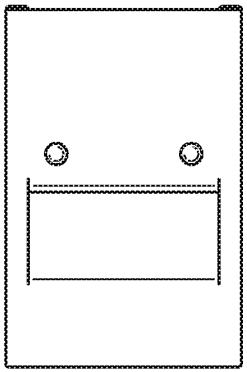
Figure 34:
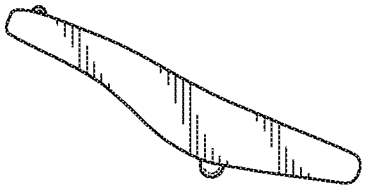
Figure 37:
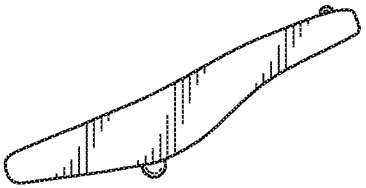
Figure 38:
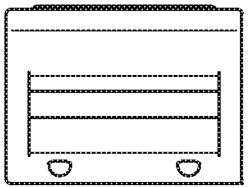
Figure 39:
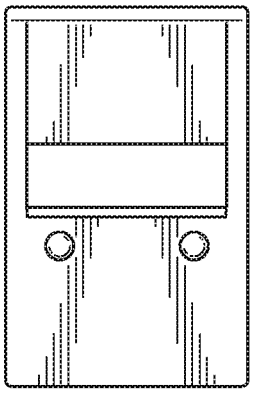
FIGS. 39-43 are plan view, front elevation, left elevation, rear elevation, and lower surface views of the lower lever.
Figure 40:
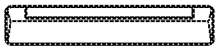
Figure 41:
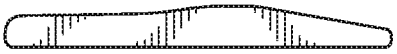
Figure 42:
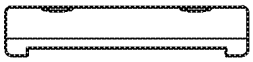
Figure 43:
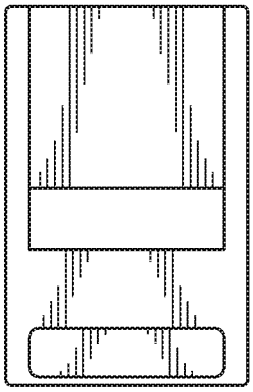

FIG. 32 illustrates gripping recess 86 on lower surface 88 of lower lever 40 facilitating grasp upon lower lever 40.

FIGS. 33-38 illustrate all surfaces of upper lever 28 for completeness.

FIGS. 39-43 illustrate all surfaces of lower lever 40 for completeness.

Figure 44:
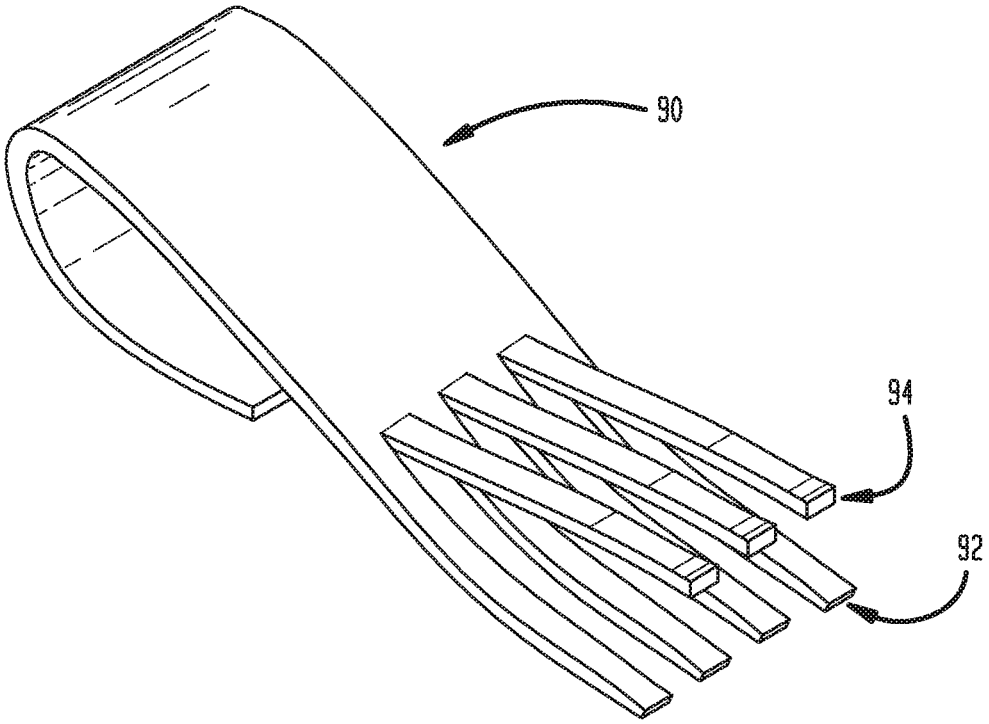
FIGS. 44 and 45 are isometric perspectives illustrating an alternative form of the clamp of the present invention not requiring plastic levers.
Figure 45:
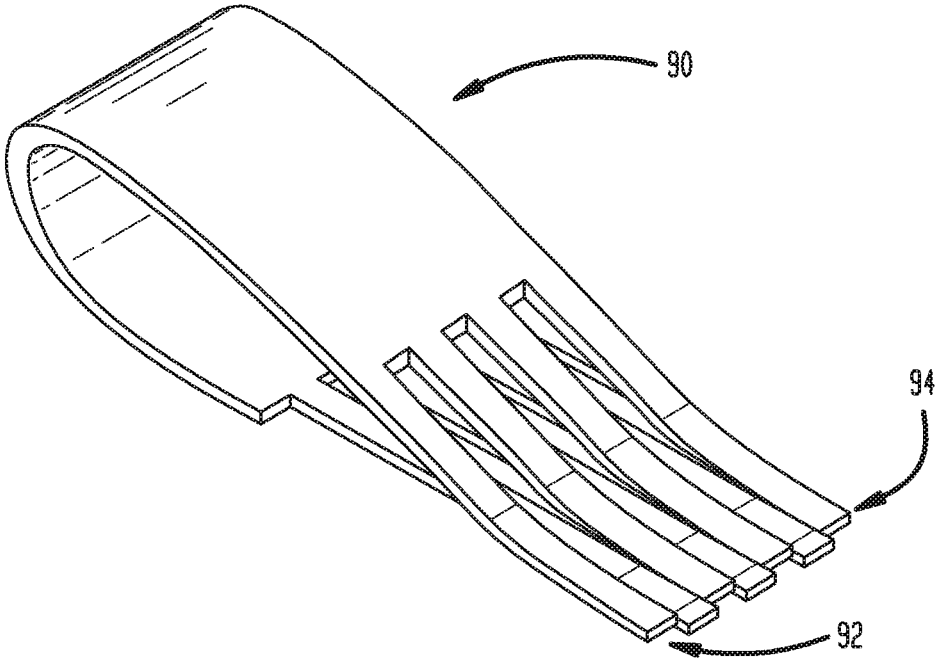

FIGS. 44 and 45 illustrate clamp 90 which is an embodiment of the present invention formed from a strip of stainless steel 12 having interleaving upper tines 92 and lower tines 94 at each end thereof. In contrast to the embodiments shown in FIGS. 1-39, clamp 90 is opened by pressing inwardly on clamp 90 to urge tines 92 and 94 to interdigitate passing through each other rather than in essence prying them apart. Note that in this embodiment, plastic levers to separate the jaws may be conveniently omitted as only pressing force is required to open clamp 90. In FIGS. 44 and 45, it is preferred that each lower tine 94 have a width of less than about 4 mm, more preferably less than about 3.5 mm, still more preferably less than about 3 mm, even still more preferably less than about 2.5 mm, most preferably having a width of between about 1.5 mm and 2.5 mm so that as the lower jaw passes over the feed dogs, some portion of fabric 66 remains in contact therewith consistently.

Figure 47:
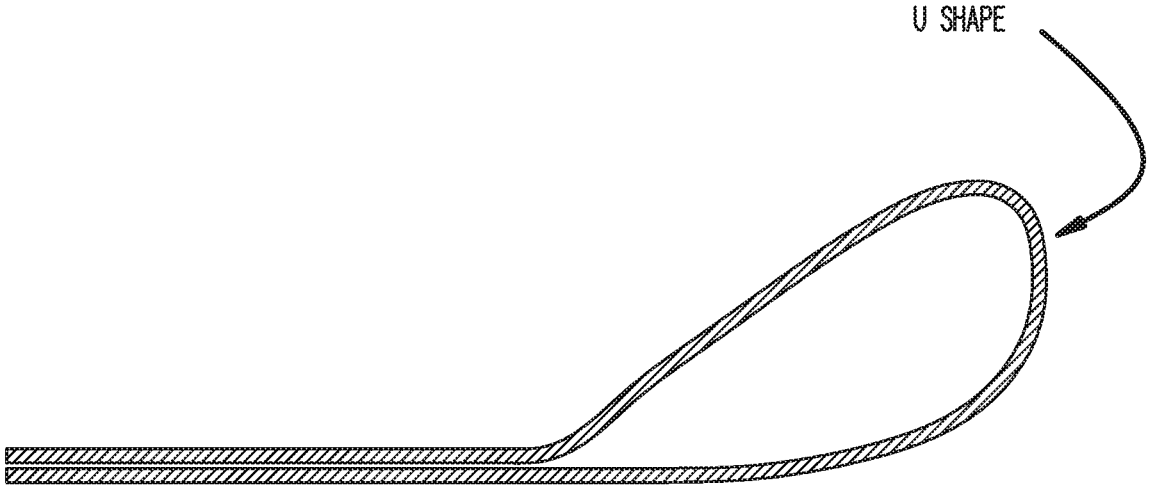

FIGS. 46 and 47 illustrate two different types of curvilinear portions 22 which may be employed in the practice of the present invention.

Figure 48:
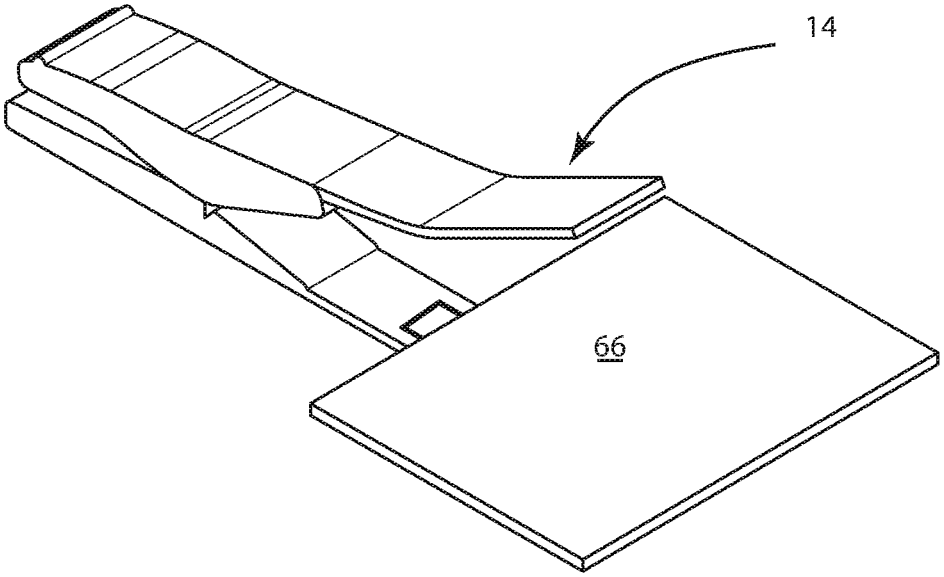
FIGS. 48 and 49 schematically illustrate an alternative construction in which the upper jaw is formed without an aperture therethrough.
Figure 49:
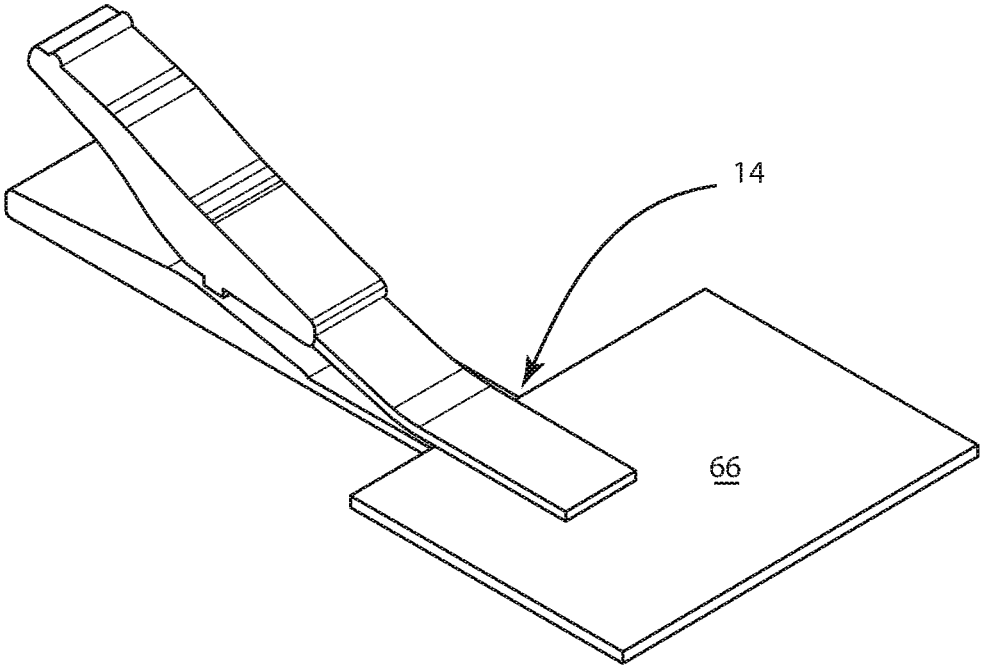

FIGS. 48 and 49 illustrate an embodiment of the present invention in which window 54 is omitted from upper jaw 14.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

As my invention, I claim:

1. A fabric clamp adapted to pass under a presser foot of a sewing machine, comprising:

a loop of resilient strip folded over upon itself, defining: an upper portion; and a generally planar lower portion; said upper portion and said generally planar lower portion being joined by a curvilinear central portion;

an upper slotted lever;

a lower slotted lever;

a terminus of said upper portion being generally planar and defining an upper planar jaw joined to said curvilinear central portion through an obtuse oblique;

a terminus of said generally planar lower portion of said loop of resilient strip defining a lower planar tongue, said curvilinear central portion urging said jaw and said tongue into adjacent deployment;

wherein said upper portion of said resilient strip passes through said upper slotted lever such that the upper slotted lever engages a lower surface of said upper portion of said resilient strip at a location along said obtuse oblique and engages other surface of said resilient strip at a location between said lower portion of said resilient strip and a location corresponding to that at which said upper lever engages the lower surface of said upper portion, said upper lever extending past said curvilinear portion; and wherein said lower portion of said resilient strip passes through said lower slotted lever, said lower lever engaging an upper surface of said lower portion of said resilient strip between said curvilinear portion and said terminus of said generally planar lower portion, said lower slotted lever extending past said curvilinear portion, said upper slotted lever and said lower slotted lever bearing against each other along a transversely extending area between said curvilinear portion of said resilient strip and said obtuse oblique;

portions of said upper lever and said lower lever extending beyond said curvilinear portion being spaced apart when said upper planar jaw and said lower planar tongue are in the adjacent deployment and said levers being urgable together against a resilience of said curvilinear central portion to displace said jaw and said tongue from the adjacent deployment;

wherein a total transverse width of portions of said tongue on said lower portion is no more than about 12 mm.

2. The fabric clamp of claim 1, wherein said resilient strip comprises stainless alloy comprising iron and chromium having a thickness of between about 0.25 mm and 1.5 mm.

3. The fabric clamp of claim 2, wherein said tongue is a solid tongue with the transverse width of said tongue on said lower portion is no more than about 3.5 mm.

4. The fabric clamp of claim 3, wherein the transverse width of said tongue on said lower portion is no more than about 2.5 mm.

5. The fabric clamp of claim 2, wherein said tongue has an aperture formed therein having a width of at least about 1.5 mm and wherein said aperture is laterally bounded by arms having a width of no more than about 4 mm.

6. The fabric clamp of claim 5, wherein the width of said aperture is at least about 2 mm.

7. The fabric clamp of claim 5, wherein said resilient strip comprises stainless alloy comprising iron and chromium having a thickness of between about 0.35 mm and 1.5 mm.

8. A fabric clamp adapted to pass under a presser foot of a sewing machine, comprising:

a loop of resilient strip comprising stainless steel having a thickness of between about 0.25 mm and 1.5 mm folded over upon itself, defining: an upper portion; and a generally planar lower portion; said upper portion and said generally planar lower portion being joined by a curvilinear central portion;

an upper slotted lever;

a lower slotted lever;

a terminus of said upper portion being generally planar and defining an upper planar jaw joined to said curvilinear central portion through an obtuse oblique, said upper planar jaw comprising a frame circumscribing a central aperture;

a terminus of said generally planar lower portion of said loop of resilient strip defining a lower planar tongue having lateral arms a defining an aperture formed therein, wherein a transverse width of said aperture is at least about 1.5 mm, and a width of each of the lateral arms is no more than about 4 mm;

said curvilinear central portion urging said jaw and said tongue into interjacent generally coplanar deployment with said tongue disposed in said central aperture;

wherein said upper portion of said resilient strip passes through said upper slotted lever such that the upper slotted lever engages a lower surface of said upper portion of said resilient strip at a location along said obtuse oblique and engages other surface of said resilient strip at a location between said lower portion of said resilient strip and a location corresponding to that at which said upper lever engages the lower surface of said upper portion, said upper lever extending past said curvilinear portion;

wherein said lower portion of said resilient strip passes through said lower slotted lever, said lower lever engaging an upper surface of said lower portion of said resilient strip between said curvilinear portion and said terminus of said generally planar lower portion, said lower slotted lever extending past said curvilinear portion, said upper lever and said lower lever bearing against each other along a transversely extending area between said curvilinear portion of said resilient strip and said obtuse oblique;

portions of said upper lever and said lower lever extending beyond said curvilinear portion being spaced apart when said upper planar jaw and said lower planar tongue are in the interjacent generally coplanar deployment and said levers being urgable together against a resilience of said curvilinear central portion to displace said jaw and said tongue from the interjacent generally coplanar deployment.

9. The fabric clamp of claim 8, wherein alignment protrusions are provided on one of said slotted levers, and alignment recesses, mateable therewith, are provided on other of said slotted levers and wherein said resilient strip comprises stainless steel comprising iron and chromium having a thickness of between about 0.35 mm and 1.5 mm.

10. A fabric clamp adapted to pass under a presser foot of a sewing machine, comprising:

a loop of resilient strip having a thickness of between about 0.25 mm and 1.5 mm comprising an alloy of iron and chromium folded over upon itself, defining: an upper portion; and a generally planar lower portion; said upper portion and said generally planar lower portion being joined by a curvilinear central portion;

a terminus of said upper portion being generally planar and defining an upper planar jaw joined to said curvilinear central portion through an obtuse oblique, said upper planar jaw comprising a frame circumscribing an aperture;

a terminus of said generally planar lower portion of said loop of resilient strip defining a lower planar tongue, said curvilinear central portion urging said jaw and said tongue into interjacent generally coplanar deployment with said tongue disposed in said aperture;

an upper slotted lever;

a lower slotted lever;

wherein said upper portion of said resilient strip passes through said upper slotted lever, engaging a lower surface of said upper portion of said resilient strip at a location along said obtuse oblique and engaging other surface of said resilient strip at a location between said lower portion of said resilient strip and a location corresponding to that at which said upper lever engages the lower surface of said upper portion, said upper lever extending past said curvilinear portion; and wherein said lower portion of said resilient strip passes through said lower slotted lever, said lower lever engaging an upper surface of said lower portion of said resilient strip between said curvilinear portion and said terminus of said generally planar lower portion, said lower slotted lever extending past said curvilinear portion, said upper lever and said lower lever bearing against each other along a transversely extending area between said curvilinear portion of said resilient strip and said obtuse oblique;

portions of said upper lever and said lower lever extending beyond said curvilinear portion being spaced apart when said upper planar jaw and said lower planar tongue are in the interjacent generally coplanar deployment and said levers being urgable together against a resilience of said curvilinear central portion to displace said jaw and said tongue from the interjacent generally coplanar deployment; and wherein when said clamp is deployed with layers of fabric between the upper planar jaw and said lower planar tongue thereof, no single portion of the lower tongue disposed below said fabric has a transverse width exceeding 5 mm and wherein each portion of the lower tongue disposed below said fabric is laterally separated from every other portion of said jaw by a distance of at least about 1.5 mm.

11. The fabric clamp of claim 10 wherein an aperture bounded by lateral arms is formed in said tongue, said aperture having a transverse width of at least about 1.5 mm, each said lateral arm having a transverse width of no more than about 5 mm and wherein said resilient strip comprises stainless steel comprising iron and chromium having a thickness of between about 0.35 mm and 1.5 mm.

12. The fabric clamp of claim 10 wherein an aperture bounded by lateral arms is formed in said tongue, said aperture having a transverse width of at least about 2 mm, each said lateral arm having a transverse width of no more than about 4 mm and wherein said resilient strip comprises stainless steel comprising iron and chromium having a thickness of between about 0.35 mm and 1.5 mm.

13. The fabric clamp of claim 10 wherein an aperture bounded by lateral arms is formed in said tongue, said aperture having a transverse width of at least about 3.5 mm, each said lateral arm having a transverse width of no more than about 3.5 mm and wherein said resilient strip comprises stainless steel comprising iron and chromium having a thickness of between about 0.35 mm and 1.5 mm.

14. The fabric clamp of claim 10 wherein an aperture bounded by lateral arms is formed in said tongue, said aperture having a transverse width of at least about 2.5 mm, each said lateral arm having a transverse width of no more than about 3 mm and wherein said resilient strip comprises stainless steel comprising iron and chromium having a thickness of between about 0.35 mm and 1.5 mm.

15. A fabric clamp adapted to pass under a presser foot of a sewing machine, comprising:

a loop of resilient strip comprising a stainless alloy comprising iron and chromium having a thickness of between about 0.25 and 1.5 mm, said resilient strip being folded over upon itself, defining: an upper portion; and a generally planar lower portion; said upper portion and said generally planar lower portion being joined by a curvilinear central portion;

a terminus of said upper portion being generally planar and defining an upper planar jaw joined to said curvilinear central portion through an obtuse oblique, said upper planar jaw comprising a frame circumscribing an aperture;

a terminus of said generally planar lower portion of said loop of resilient strip defining a lower planar jaw, said curvilinear central portion urging said upper planar jaw and said lower planar jaw into interjacent generally coplanar deployment with said lower planar jaw disposed in said aperture of said upper planar jaw;

said lower planar jaw and said upper planar jaw being urgable apart against a resilience of said curvilinear central portion to displace said upper planar jaw and said lower planar jaw from the interjacent generally coplanar deployment; and wherein when the fabric clamp is disposed grasping an assemblage of fabric with the upper jaw above said assemblage of fabric and the lower jaw beneath said assemblage of fabric, no portion of the jaw beneath said assemblage of fabric has a lateral width of more than 5 mm and each portion of said jaw beneath said assemblage of fabric is laterally separated from every other portion of said jaw beneath said assemblage of fabric by a lateral distance of more than about 1.5 mm.

16. The fabric clamp of claim 15 wherein the portion of said jaw beneath said assemblage of fabric comprises a tongue having a transverse width of no more than about 5 mm and wherein said resilient strip comprises stainless steel having a thickness of between about 0.35 mm and 1.5 mm.

17. The fabric clamp of claim 15 wherein the portion of said jaw beneath said assemblage of fabric comprises a tongue having an aperture formed therein, said aperture being laterally bounded by lateral arms, said aperture having a transverse width of at least about 1.5 mm, each said lateral arm having a transverse width of no more than about 5 mm and wherein said resilient strip comprises stainless steel having a thickness of between about 0.35 mm and 1.5 mm.

18. The fabric clamp of claim 17 wherein the transverse width of said aperture is at least about 2 mm, the transverse width of each said lateral arm is no more than about 4 mm.

19. The fabric clamp of claim 18 wherein the transverse width of said aperture is at least about 3 mm, the transverse width of each said lateral arm is no more than about 3.5 mm and wherein said resilient strip comprises stainless steel having a thickness of between about 0.35 mm and 1.5 mm.

20. A fabric clamp adapted to pass under a presser foot of a sewing machine, comprising:

a loop of resilient strip comprising a stainless alloy comprising iron and chromium having a thickness of between about 0.25 and 1.5 mm, said resilient strip being folded over upon itself, defining: an upper portion; and a generally planar lower portion; said upper portion and said generally planar lower portion being joined by a curvilinear central portion;

a terminus of said upper portion being generally planar and defining an upper planar jaw joined to said curvilinear central portion through an obtuse oblique;

a terminus of said generally planar lower portion of said loop of resilient strip defining a lower planar jaw, said curvilinear central portion urging said upper planar jaw and said lower planar jaw into parallel adjacent deployment;

said lower and upper jaw being urgable apart against a resilience of said curvilinear central portion to displace said upper jaw and said lower jaw from the adjacent deployment; and wherein when the fabric clamp is disposed grasping an assemblage of fabric with the upper jaw above said assemblage of fabric and the lower jaw beneath said assemblage of fabric, no portion of the jaw beneath said assemblage of fabric has a lateral width of more than 5 mm and any portion of said jaw beneath said assemblage of fabric which is laterally separated from another portion of said jaw beneath said assemblage of fabric, is laterally separated from every other portion of said jaw beneath said assemblage of fabric by a lateral distance of more than about 1.5 mm.

* * * * *